US005437970A

United States Patent [19]

Shono

[11] Patent Number: 5,437,970

[45] Date of Patent: Aug. 1, 1995

[54] SILVER HALIDE COLOR PHOTOGRAPHIC MATERIAL AND METHOD FOR FORMING AN IMAGE

[75] Inventor: Akiko Shono, Minami-ashigara, Japan

[73] Assignee: Fuji Photo Film Co., Ltd., Kanagawa, Japan

[21] Appl. No.: 167,203

[22] Filed: Dec. 16, 1993

[30] Foreign Application Priority Data

Dec. 18, 1992 [JP] Japan ..... 4-356114

[51] Int. Cl.[6] ..... G03C 1/825

[52] U.S. Cl. ..... 430/522; 430/533; 430/627

[58] Field of Search ..... 430/522, 533, 627

[56] References Cited

U.S. PATENT DOCUMENTS

| | | | |
|---|---|---|---|
| 4,895,786 | 1/1990 | Kurematsu et al. | 430/522 |
| 4,980,272 | 12/1990 | Kuse et al. | 430/521 |
| 4,996,138 | 2/1991 | Murai et al. | 430/522 |
| 5,035,985 | 7/1991 | Adachi et al. | 430/522 |

FOREIGN PATENT DOCUMENTS

| | | |
|---|---|---|
| 507489 | 10/1992 | European Pat. Off. . |
| 4-18545 | 1/1992 | Japan . |

OTHER PUBLICATIONS

James, T H ed, The Theory of the Photographic Process. 4th Edition, Macmillan Publishing Co., Inc., 1977, p. 67.

*Primary Examiner*—Janet C. Baxter

*Attorney, Agent, or Firm*—Sughrue, Mion, Zinn, Macpeak & Seas

[57] ABSTRACT

There is disclosed a silver halide color photographic material and a method for forming an image utilizing the same. The photographic material has, on a reflective support, photographic constitutional layers comprising photosensitive silver halide emulsion layers and non-photosensitive hydrophilic colloid layers, and comprises a reflective support covered the surface to be emulsion-coated with a composition of a polyester resin and a white pigment; and a non-photosensitive hydrophilic colloid layer containing a dispersion of solid fine particles of a compound represented by the following formula (Sa); with the total amount of gelatin contained in the photographic constitutional layers being limited; and with the silver halide emulsion being a high-silver-chloride emulsion:

$$D-(X)_y \qquad \text{formula (Sa)}$$

wherein D represents a compound having a chromophore; X represents a dissociable proton or a group having a dissociable proton.

19 Claims, No Drawings

SILVER HALIDE COLOR PHOTOGRAPHIC MATERIAL AND METHOD FOR FORMING AN IMAGE

FIELD OF THE INVENTION

The present invention relates to a silver halide color photographic material, and more particularly to a silver halide color photographic material that can be processed rapidly to form an image improved in sharpness and non-coloring property of the white background, and that has storage stability after emulsion coating; and the invention relates to a method for forming an image utilizing the silver halide color photographic material.

BACKGROUND OF THE INVENTION

In color photographic materials used for appreciation, recording, and preservation of images, the demand for high image quality and improvement in rapid processability has increased progressively. As means of making the image quality of color photographic materials high, can be mentioned the addition of antihalation dyes or irradiation neutralizing dyes, the improvement of sharpness by decreasing the coating amount of gelatin. Further, there can be mentioned the improvement of color reproduction by using photographic couplers excellent in spectral absorption characteristics of the color-formed dyes obtained therefrom, and the prevention of undesired coloring due to residual color, for example, of dyes on the support or in the hydrophilic layer applied on the support.

As means of improving sharpness, which is required for making high the image quality of color photographic materials, generally, antihalation dyes and irradiation neutralizing dyes are used effectively.

The dyes used for such a purpose are required to have, for example, the following characteristics:

(1) the dyes are completely decolored or are easily dissolved out from the photographic material in the photographic processing steps, so that harmful coloring does not remain on the photographic material, (2) the dyes do not chemically affect harmfully, for example, the silver halide emulsion in the photographic material; e.g., they do not change the sensitivity of the silver halide emulsion or fog the silver halide emulsion, and (3) the dyes have proper spectral absorption suitable for the application purpose.

There have been made efforts to find photographic dyes that satisfy all of the above conditions and the following dyes are found: for example, oxonol dyes described, for example, in U.S. Pat. Nos. 3,469,985 and 4,078,933, and other azo dyes, anthraquinone dyes, arylidene dyes, styryl dyes, triarylmethane dyes, merocyanine dyes, and cyanine dyes.

Since these dyes are generally soluble in water, they diffuse eventually into all of the layers of the photographic material. Accordingly, to improve the sharpness of the intended dye image, a large amount of the dye must be added, taking the diffusion of the dye into all of the other layers into account. In this case, if a further increase of the rapidness of the photographic processing, as demanded in recent years, is taken into consideration, it is easily anticipated that coloring of the white background due to residual color of dyes and the like will increase.

If the amount of the dye to be added is decreased, on one hand the above coloring of the white background is decreased, while on the other hand the sharpness is deteriorated, which is contrary to high image quality of the color photographic material.

In contrast to the above method wherein a dye is used that will diffuse into all the layers, some methods wherein a specific hydrophilic colloid layer is selectively colored are suggested.

For example, in order to prevent a dye from diffusing, for example, JP-A ("JP-A" means unexamined published Japanese patent application) No. 65230/1975 describes a method wherein, as a mordant, a hydrophilic polymer containing a part charged oppositely to the dye ion is allowed to be present in the hydrophilic layer. However, although these methods are effective in preventing the dye molecules from diffusing, the rate of the dissolve-out at the time of photographic processing is made poor.

A means is disclosed, for example, in European Patent 0,276,566 A1 and WO 88-04794, wherein a dye is dispersed in a specific hydrophilic colloid layer and fixed there in the solid state.

However, in this case, again it was found that when the dye dispersion required to improve sharpness is added, the rate of the dissolve-out of the dye at the time of photographic processing is made poor.

In this case, also, although the rate of the dissolve-out can be made good by decreasing the amount of the added dye, the sharpness is made poor. This is contrary to the trend of making the image quality of color photographic material high.

As other means of improving sharpness, a method wherein colloidal silver in the form of fine particles is contained in a specific non-photosensitive hydrophilic colloid layer, and a method wherein a large amount of titanium oxide particles is contained in a water-resistant resin covering a reflective support substrate, as described in European Patent 337490 A, are known.

However, it was found that, in order to improve sharpness satisfactorily by these methods, a large amount of the colloidal silver or the white pigment is required to be added; and in addition a change in sensitivity due to coloring of the white background after photographic processing, or due to deterioration of the storage stability of the photographic material, occurs. Thus, a technique of satisfying all of the characteristics for making the image quality high has not yet been found.

SUMMARY OF THE INVENTION

An object of the present invention is to provide a silver halide color photographic material excellent, for example, in image sharpness, storage stability, and non-coloring property of the white background of an image.

Another object of the present invention is to provide a silver halide color photographic material suitable for rapid processing.

Other and further objects, features, and advantages of the invention will appear more evident from the following description.

DETAILED DESCRIPTION OF THE INVENTION

The present inventors, having studied in various ways, have found that the above objects can be attained by the following constitution:

(1) A silver halide color photographic material having, on a reflective support, photographic constitutional layers comprising at least one photosensitive silver halide emulsion layer and at least one non-photosensitive hydrophilic colloid layer, which comprises a reflective support obtained by covering at least the surface to be emulsion-coated, with a composition of a polyester resin comprising a white pigment mixed and dispersed therein, wherein the major component of the polyester resin is a polyester synthesized by polycondensation of a dicarboxylic acid and a diol; at least one non-photosensitive hydrophilic colloid layer containing a dispersion of solid fine particles of at least one compound represented by the following formula (Sa); with the total amount of gelatin contained in the photographic constitutional layers being 8.5 g/m$^2$ or less; and with the silver chloride content of the silver halide emulsion contained in photosensitive silver halide emulsion layer being 90 mol % or more:

$$D-(X)_y \qquad \text{formula (Sa)}$$

wherein D represents a compound having a chromophore; X represents a dissociable proton which is bonded to D directly or through a divalent linking group or a group having a dissociable proton, and y is an integer of 1 to 7.

(2) The silver halide color photographic material as stated in (1) above, wherein at least one photosensitive silver halide emulsion layer or hydrophilic colloid layer contains at least one compound represented by the following formula (I), (II), or (III):

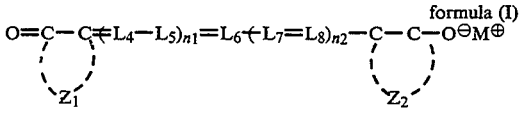

formula (I)

wherein $Z_1$ and $Z_2$, which may be the same or different, each represent a group of nonmetal atoms required to form a heterocyclic ring moiety; $L_4$, $L_5$, $L_6$, $L_7$, and $L_8$ each represent a methine group; $n_1$ and $n_2$ each are 0 or 1; and $M^{\oplus}$ represents a hydrogen or other monovalent cation, $$Ar_1-N=N-Ar_2 \qquad \text{formula (II)}$$

wherein $Ar_1$ and $Ar_2$, which may be the same or different, each represent an aryl group or a heterocyclic group,

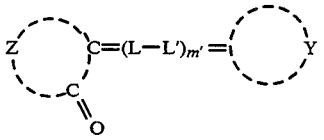

wherein L and L' each represent a substituted or unsubstituted methine group or a nitrogen atom, Z and Y each represent a group of nonmetal atoms required to form a heterocyclic moiety, and m' is 0, 1, 2, or 3.

(3) The silver halide color photographic material as stated in (2) above, wherein the polyester resin of the reflective support is one whose major component is polyethylene terephthalate.

(4) The silver halide color photographic material as stated in (2) above, wherein the reflective support is one obtained by covering the surface to be emulsion-coated of the support, with a composition of a polyester resin comprising a white pigment mixed and dispersed therein, wherein the polyester is one synthesized by polycondensation of mixed dicarboxylic acids of terephthalic acid and isophthalic acid (preferably in a molar ratio of from 9/1 to 2/8) and a diol, and by covering the other surface of the support with a resin or a resin composition containing a powder, etc. being mixed and dispersed into the resin.

(5) The silver halide color photographic material as stated in (2) above, wherein the reflective support is one obtained by covering the surface to be emulsion-coated of the support, with a composition of a polyester resin comprising a white pigment mixed and dispersed therein, wherein the polyester is one synthesized by polycondensation of mixed dicarboxylic acids of terephthalic acid and naphthalenedicarboxylic acid (preferably in a molar ratio of from 9/1 to 2/8) and a diol, and by covering the other surface of the support with a resin or a resin composition containing a powder, etc. being mixed and dispersed into the resin.

(6) The silver halide color photographic material as stated in (3) or (4) above, wherein the diol is ethylene glycol.

(7) The silver halide color photographic material as stated in (2) above, wherein the white pigment is titanium oxide and the weight ratio of the titanium oxide to the resin, whose major competent is a polyester, is from 5/95 to 50/50.

(8) A method for forming a color image, which comprises exposing the silver halide color photographic material, as stated in (2) above, to light by a scanning exposure method with the exposure time per picture element being $10^{-4}$ sec or less, followed by color development.

The present invention will now be described in detail below.

It is necessary that the reflective support in the present invention is covered at least the surface to be emulsion-coated of the support with a composition of resin comprising a white pigment mixed and dispersed therein, wherein the major component is a polyester. In the specification and claims of the present invention, the term "major component" means that the content of the said component is 50 wt % or more.

This polyester is one synthesized by polycondensation of a dicarboxylic acid and a diol. As preferable dicarboxylic acids, for example, terephthalic acid, isophthalic acid, and naphthalenedicarboxylic acid can be mentioned. As preferable diols, for example, ethylene glycol, butylene glycol, neopentyl glycol, triethylene glycol, butanediol, hexylene glycol, an adduct of bisphenol A with ethylene oxide (2,2-bis(4-(2-hydroxyethyloxy)phenyl)propane), and 1,4-dihydroxymethylcyclohexane can be mentioned.

In the present invention, various polyesters prepared by polycondensation of one or a mixture of these dicarboxylic acids with one or a mixture of these diols can be used. In particular, at least one of the dicarboxylic acids is preferably terephthalic acid. As the dicarboxylic acid component, a mixture of terephthalic acid and isophthalic acid (in a molar ratio of from 9/1 to 2/8), or a mixture of terephthalic acid and naphthalenedicarboxylic acid (in a molar ratio of from 9/1 to 2/8), is also preferably used. As the diol, ethylene glycol or a mixed diol containing ethylene glycol is preferably used. Preferably the molecular weight of these polymers is 30,000 to 50,000.

Also, a mixture of two or more of these polyesters having different compositions is preferably used. Further, a mixture of these polyesters with other resins can also be used preferably. As the other resins that can be mixed, wide varieties of resins capable of being extruded at 270° to 350° C. can be chosen, such as polyolefins, for example polyethylenes and polypropylenes; polyethers, for example polyethylene glycols, polyoxymethylenes, and polyoxypropylenes; polyester polyurethanes; polyether polyurethanes; polycarbonates; and polystyrenes. One or more of these resins can be blended. For instance, 90 wt % of polyethylene terephthalate can be mixed with 6 wt % of polyethylene and 4 wt % of polypropylene. Although the mixing ratio of the polyester to the other resin varies depending on the type of the resin to be mixed, in the case of polyolefins, suitably the weight ratio of the polyester to the other resin is 100/0 to 80/20. If the ratio falls outside this range, the physical properties of the mixed resin drop drastically. In the case of resins other than polyolefins, the polyester is mixed with the resin in a weight ratio ranging from 100/0 to 50/50. If the ratio of polyester is too small, the effect of the present invention cannot be obtained satisfactorily.

As the white pigment to be mixed and dispersed into the polyester on the reflective support in the present invention, inorganic pigments, such as titanium oxide, barium sulfate, lithopone, aluminum oxide, calcium carbonate, silicon oxide, antimony trioxide, titanium phosphate, zinc oxide, white lead, and zirconium oxide; and organic finely divided powders, such as finely divided powders of a polystyrene and a styrene/divinylbenzene copolymer, can be mentioned.

Among these pigments, titanium dioxide is particularly effectively used. The titanium dioxide may be of the rutile type or the anatase type, and it may be one prepared by either the sulfate process or the chloride process. Specific trade names of titanium dioxide include, for example, KA-10 and KA-20, manufactured by Titanium Kogyo Co., and A-220, manufactured by Ishihara Sangyo Co..

Preferably, the white pigment to be used has an average particle diameter of 0.1 to 0.8 μm. If the average particle diameter is too small, it is not preferable because it is difficult to disperse the white pigment uniformly into the resin. On the other hand, if the average particle diameter is too large, the whiteness becomes unsatisfactory and the coated surface becomes rough, thereby adversely affecting the image quality.

The mixing weight ratio of the polyester to the white pigment is from 98/2 to 30/70, preferably from 95/5 to 50/50, and particularly preferably from 90/10 to 60/40. If the amount of the white pigment is too small, the whiteness is insufficient; while if the amount is too much, the smoothness of the surface of the obtained support for photographic paper is unsatisfactory and a support for photographic paper excellent in glossiness cannot be obtained.

The polyester and the white pigment are mixed together with a dispersing agent, such as a metal salt of a higher fatty acid, a higher fatty acid ethyl ester, a higher fatty acid amide, and a higher fatty acid, by a kneader, such as a twin roll, a triplet roll, a kneader, and a Banbury mixer. An antioxidant may be contained in the resin layer, in an amount of 50 to 1,000 ppm based on the resin.

The thickness of the polyester/white pigment composition that is coated on the surface to be emulsion-coated of the support for use in the present invention is preferably 5 to 100 μm, more preferably 5 to 80 μm, and particularly preferably 10 to 50 μm. If the cover is too thick, problems related to the physical properties arise and, for example, the resin becomes too brittle and cracks. On the other hand, if the cover is too thin, the waterproofness of the coating that is originally intended is apt to be damaged; in addition, the whiteness and the surface smoothness cannot be satisfied simultaneously; and with respect to the physical properties the coating becomes too soft.

In the present invention, preferably the opposite surface to surface to be emulsion-coated is covered with a resin whose main component is polyethyleneterephthalate.

Preferably the thickness of the resin or the resin composition that covers the surface opposite to the emulsion-coated surface of the base paper is 5 to 100 μm, more preferably 10 to 50 μm; and if it is too thick, problems related to the physical properties arise and, for example, the resin becomes too brittle and cracks. If it is too thin, the waterproofness of the covering that is originally intended is impaired; and in addition with respect to the physical properties the covering becomes too soft. Resin or resin composition that covers this surface is preferably polyester.

As a process for covering the surface to be emulsion-coated and the opposite surface, for example, the melt extrusion lamination process can be mentioned.

The base paper to be used for the reflective support of the present invention is chosen from materials generally used for photographic paper. That is, the main raw material is natural pulp from, for example, softwoods and hardwoods, to which, if necessary, is added, for example, a filler, such as clay, talc, calcium carbonate, and urea resin fine particles; a sizing agent, such as a rosin, an alkylketene dimer, a higher fatty acid, an epoxidized fatty acid amide, paraffin wax, and an alkenyl succinate; a paper strength-reinforcing agent, such as a starch, a polyamide polyamine epichlorohydrin, and a polyacrylamide; and a fixing agent, such as aluminum sulfate, and a cationic polymer.

Although the kind and thickness of the base paper are not particularly restricted, desirably the basis weight is 50 g/m$^2$ to 250 g/m$^2$. Preferably, the base paper is surface-treated by applying heat and pressure thereto, for example, by a machine calender or a supercalender, in order to improve the smoothness and the planeness.

The above smoothness is represented by using the surface roughness of the support as a scale. This surface roughness of the support will now be described.

The surface roughness uses the center line average surface roughness as a scale.

The center line average surface roughness is defined as follows. An area SM is cut out from the rough curved surface at the center surface thereof, the X-axis and the Y-axis of the rectangular coordinate axes are placed on the center line of the cutout, the axis orthogonal to the center line is assumed to be the Z-axis, and then the value given by the following expression is defined as the center line average surface roughness (SRa) in μm.

$$SRa = \frac{1}{SM} \int_0^{L_X} \int_0^{L_Y} |f(X, Y)| dX \cdot dY$$

wherein LxLy=SM, and Z=f(X,Y)

The values of the center line average surface roughness and the height of the projection from the center line can be found by measuring an area of 5 $mm^2$ using, for example, a three-dimensional surface roughness tester (SE-30H, manufactured by Kosaka-kenkyusho KK), which has a diamond needle having a diameter of 4 μm, with the cutoff value being 0.8 mm, the horizontal scale-up ratio being 20, and the vertical scale-up ratio being 2,000. At that time, the feeding speed of the sensing needle is preferably on the order of 0.5 mm/sec. Based on this measurement, preferably, the support has a value of 0.15 μm or less, more preferably 0.10 μm or less. Using a support having such a surface roughness (smoothness), a color print having a surface excellent in smoothness can be obtained.

Before the base paper is coated with the mixed composition of a polyester and a white pigment mentioned above, preferably the surface of the base paper is pretreated, for example, with a corona discharge treatment, a flame treatment, or an undercoat.

When a polyester, such as polyethylene terephthalate, is used, since the adhesion to the photographic emulsion is weak in comparison with the case wherein a polyethylene is used, preferably, after the melt extrusion lamination of the polyester to the base paper, the polyester surface is subjected to a corona discharge treatment and a hydrophilic colloid layer is applied.

Also preferably the surface of the thermoplastic resin, mainly made up of a polyester, is coated with an undercoat liquid containing a compound represented by the following formula (U):

formula (U)

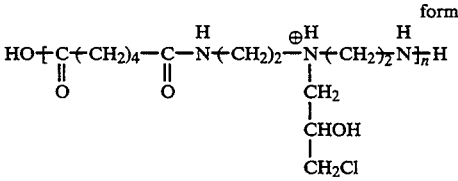

n is an integer of 1 to 7

Preferably the coating amount of the compound represented by formula (U) is 0.1 $mg/m^2$ or more, more preferably 1 $mg/m^2$ or more, and most preferably 3 $mg/m^2$ or more; and the larger the amount is, the higher the adhesion can be increased, but an excessive amount is disadvantageous in view of cost.

In order to improve the coating ability of the undercoat solution to the resin surface, preferably alcohols, such as methanol, are added. In this case, the proportion of the alcohols is preferably 20 wt % or more, more preferably 40 wt % or more, and most preferably 60 wt % or more. To improve the coating ability further, various surface-active agents, such as anionic-type, cationic-type, amphoteric-type, nonionic-type, fluorocarbon-type, and organosilicon-type surface-active agents, are preferably added.

Further, preferably, a water-soluble polymer, such as gelatin, is added to obtain a good surface for coating with the undercoat solution.

In view of the stability of the compound of formula (U), preferably the pH of the solution is 4 to 11, more preferably 5 to 10.

Before applying the undercoat solution, preferably the thermoplastic resin surface is treated. As the surface treatment, for example, a corona discharge treatment, a flame treatment, or a plasma treatment can be used.

To apply the undercoat solution, a generally well-known coating process can be used, such as a gravure coating process, a bar coating process, a dip coating process, an air-knife coating process, a curtain coating process, a roller coating process, a doctor coating process, and an extrusion coating process.

The drying temperature of the coat is preferably 30° to 100° C., more preferably 50° to 100° C., and most preferably 70° to 100° C.; the upper limit is determined by the heat resistance of the resin, and the lower limit is determined by the production efficiency.

Now the compound represented by formula (Sa) will be described in detail.

The compound having a chromophore and represented by D can be selected from many known dye compounds, including, for example, oxonol dyes, merocyanine dyes, cyanine dyes, arylidene dyes, azomethine dyes, triphenylmethane dyes, azo dyes, anthraquinone dyes, and indocyanine dyes.

The dissociable proton or the group having a dissociable proton, represented by X, has the following property: When the compound represented by formula (Sa) is added into the silver halide photographic material of the present invention, the dissociable proton or the group having a dissociable proton, represented by X, does not dissociate and has a property of making the compound of formula (Sa) substantially insoluble in water, while, when the silver halide photographic material of the present invention is developed, the dissociable proton or the group having a dissociable proton, represented by X, dissociates and makes the compound represented by formula (Sa) substantially soluble in water. As examples of these groups can be mentioned a carboxylic acid group, a sulfonamido group, an arylsulfamoyl group, a sulfonylcarbamoyl group, a carbonylsulfamoyl group, and an enol group of oxonol dyes.

Out of the compounds represented by formula (Sa), preferable ones are those represented by the following formulae (Sb), (Sc), (Sd), and (Se):

$$A_1{=}L_1{\rightleftharpoons}L_2{=}L_3{\rightleftharpoons}_m Q \qquad \text{formula (Sb)}$$

$$A_1{=}L_1{\rightleftharpoons}L_2{=}L_3{\rightleftharpoons}_n A_2 \qquad \text{formula (Sc)}$$

$$A_1{\rightleftharpoons}L_1{-}L_2{\rightleftharpoons}_p B_1 \qquad \text{formula (Sd)}$$

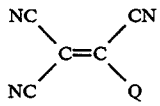

formula (Se)

wherein $A_1$ and $A_2$ each represent an acid nucleus; $B_1$ represents a basic nucleus; Q represents an aryl group or a heterocyclic ring moiety, $L_1$, $L_2$, and $L_3$ each represent a methine group; m is 0, 1, or 2; and n and p are each 0, 1, 2, or 3; provided that the molecule of the compounds represented by formulae (Sa) to (Se) has at least one group selected from the group consisting of a carboxylic acid group, a sulfonamido group, an arylsulfamoyl group, a sulfonylcarbamoyl group, a carbonylsulfamoyl group, and an enol group, and the molecule does not have other water soluble groups (e.g. a sulfonic acid group and a phosphoric acid group).

The acid nucleus represented by $A_1$ or $A_2$ is preferably a cyclic ketomethylene compound or a compound having a methylene group between electron-attracting groups. As the cyclic ketomethylene compound can be mentioned 2-pyrazolin-5-one, rhodanine, hydantoin, thiohydantoin, 2,4-oxazolidinedione, isooxazolone, barbituric acid, thiobarbituric acid, indandione, dioxopyrazolo-pyridine, hydroxypyridone, pyrazolizinedione, and 2,5-dihyrofuran, each of which compounds may be substituted.

The compound having a methylene group between electron-attracting groups can be represented by $Z_3CH_2Z_4$, wherein $Z_3$ and $Z_4$ each represent CN, $SO_2R_{11}$, $COR_{11}$, $COOR_{12}$, $CONHR_{12}$, or $SO_2NHR_{12}$, in which $R_{11}$ represents an alkyl group, an aryl group, or a heterocyclic group, $R_{12}$ represents a hydrogen atom or a group represented by $R_{11}$, and the groups represented by $R_{11}$ and $R_{12}$ may be substituted.

As examples of the basic nucleus represented by $B_1$ can be mentioned pyridine, quinoline, indolenine, oxazole, imidazole, thiazole, benzoxazole, benzoimidazole, benzothiazole, oxazoline, naphthoxzole, and pyrrole, each of which nucleuses may be substituted.

As examples of the aryl group represented by Q can be mentioned a phenyl group and a naphthyl group, each of which groups may be substituted. As examples of the heterocyclic group represented by Q can be mentioned pyrrole, indole, furan, thiophene, imidazole, pyrazole, indolizine, quinoline, carbazole, phenothiazine, phenoxazine, indoline, thiazole, pyridine, pyridazine, thiadiazine, pyran, thiopyran, oxadiazole, benzoquinoline, thiadiazole, pyrrothiazole, pyrrolopyridazine, tetrazole, oxazole, coumarin, and coumarone, each of which groups may be substituted.

The methine group represented by $L_1$, $L_2$, and $L_3$ may have substituents, which substituents may bond together to form a 5- to 6-membered ring.

The substituents that may be possessed by the above groups are not particularly restricted unless the substituents do not cause the compounds represented by formulae (Sa) to (Se) to be substantially dissolved in water having a pH of 5 to 7. Examples include a carboxylic acid group, a sulfonamido group having 1 to 10 carbon atoms (e.g., methanesulfonamido, benzenesulfonamido, butanesulfonamido, and n-octanesulfonamido), a sulfamoyl group having 0 to 10 carbon atoms (e.g., unsubstituted sulfamoyl, methylsulfamoyl, phenylsulfamoyl, and butylsulfamoyl), a sulfonylcarbamoyl group having 2 to 10 carbon atoms (e.g., methanesulfonylcarbamoyl, propanesulfonylcarbamoyl, and benzenesulfonylcarbamoyl), an acylsulfamoyl group having 1 to 10 carbon atoms (e.g., acetylsulfamoyl, propionylsulfamoyl, pivaloylsulfamoyl, and benzoylsulfamoyl), an alkyl group having 1 to 8 carbon atoms (e.g., methyl, ethyl, isopropyl, butyl, hexyl, 2-hydroxyethyl, 4-carboxybutyl, 2-methoxyethyl, benzyl, phenetyl, 4-carboxybenzyl, and 2-diethylaminoethyl), an alkoxy group having 1 to 8 carbon atoms (e.g., methoxy, ethoxy, and butoxy), a halogen atom (e.g., fluorine, chlorine, and bromine), an amino group having 0 to 10 carbon atoms (e.g., unsubstituted amino, dimethylamino, diethylamino, and carboxyethylamino), an ester group having 2 to 10 carbon atoms (e.g., methoxycarbonyl), an amido group having 1 to 10 carbon atoms (e.g., acetylamino and benzamido), a carbamoyl group having 1 to 10 carbon atoms (e.g., unsubstituted carbamoyl, methylcarbamoyl, and ethylcarbamoyl), an aryl group having 6 to 10 carbon atoms (e.g., phenyl, naphthyl, 4-carboxyphenyl, 3-carboxyphenyl, 3,5-dicarboxyphenyl, 4-methanesulfonamidophenyl, and 4-butanesulfonamidophenyl), an acyl group having 1 to 10 carbon atoms (e.g., acetyl, benzoyl, and propanoyl), a sulfonyl group having 1 to 10 carbon atoms (e.g., methanesulfonyl and benzenesulfonyl), a ureido group having 1 to 10 carbon atoms (e.g., ureido and methylureido), a urethane group having 2 to 10 carbon atoms (e.g., methoxycarbonylamino and ethoxycarbonylamino), a cyano group, a hydroxyl group, a nitro group, and a heterocyclic group (e.g., a 5-carboxybenzoxazole ring, a pyridine ring, a sulfolane ring, and a furan ring).

Examples of the compounds represented by formulae (Sa) to (Se) used in the present invention are as follows:

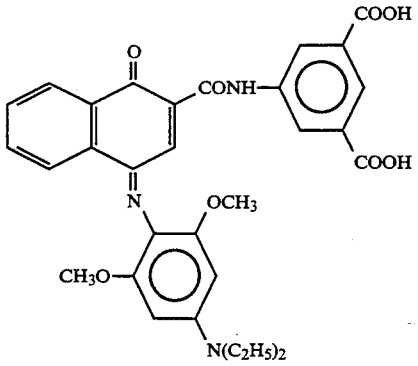

(Sa-1)

-continued
(Sa-2)
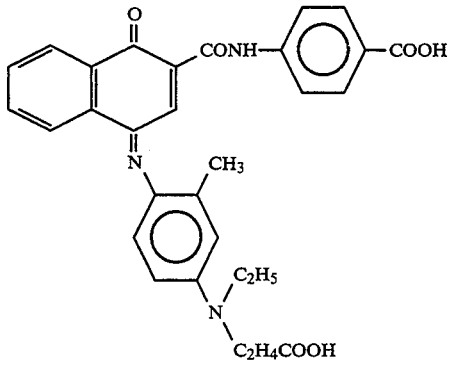
(Sa-3)
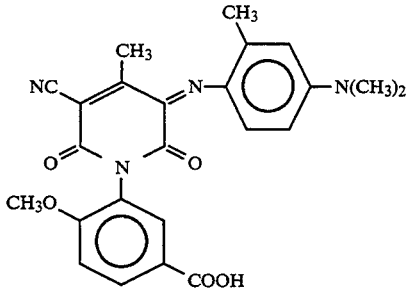
(Sa-4)
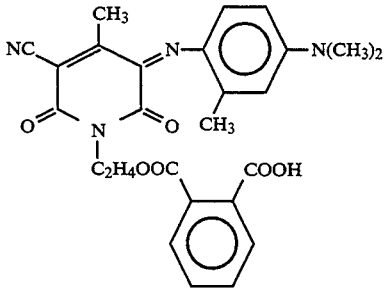
(Sb-1)
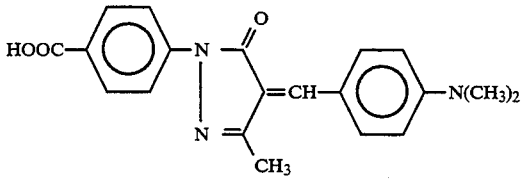
(Sb-2)
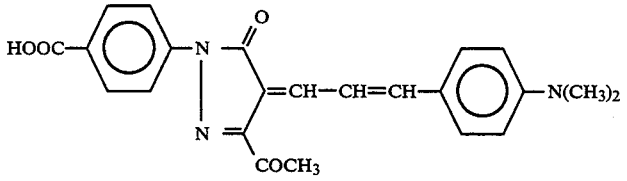
(Sb-3)
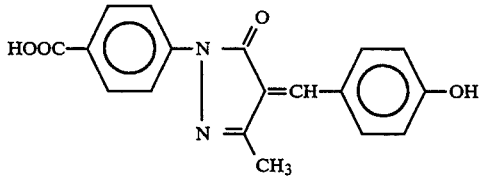

-continued
(Sb-4)
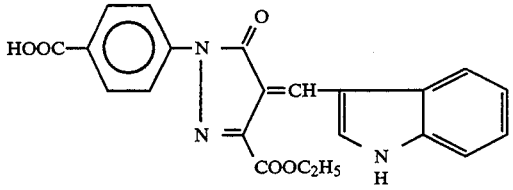
(Sb-5)
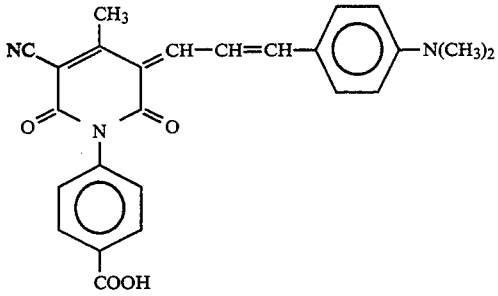
(Sb-6)
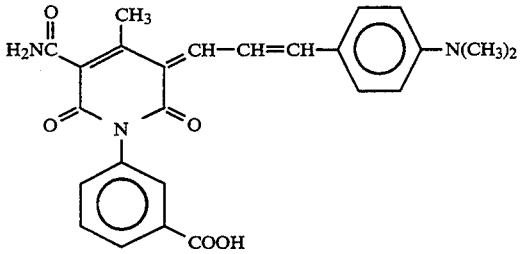
(Sb-7)
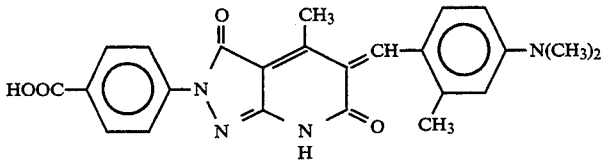
(Sb-8)
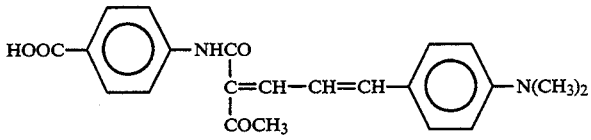
(Sb-9)
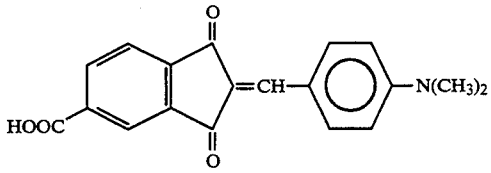
(Sb-10)
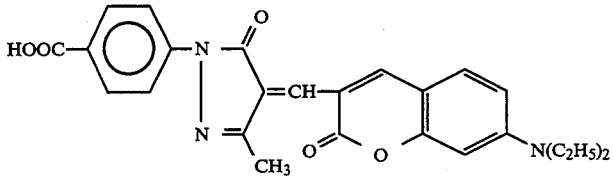

-continued
(Sb-11)
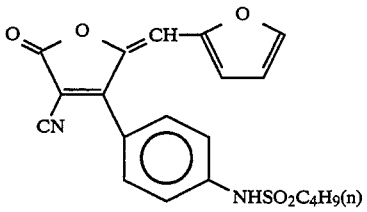
(Sb-12)
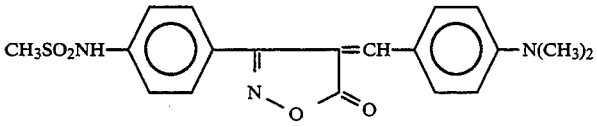
(Sb-13)
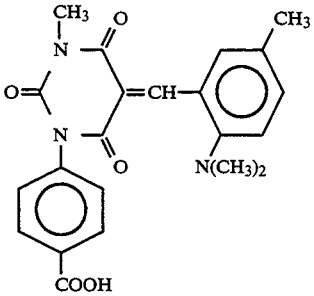
(Sb-14)
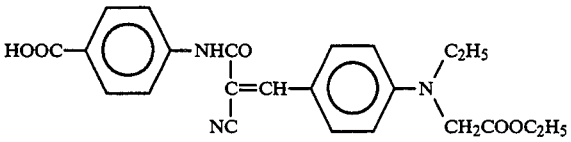
(Sc-1)
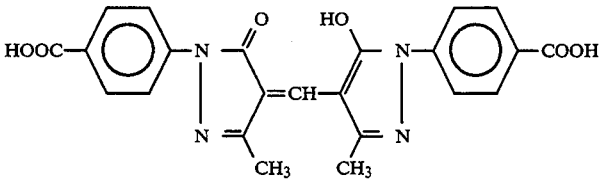
(Sc-2)
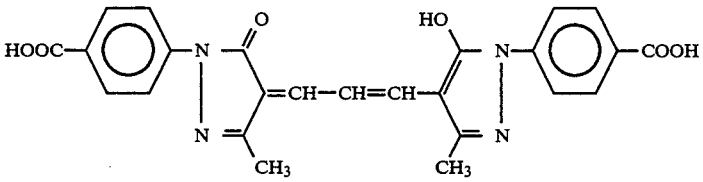
(Sc-3)
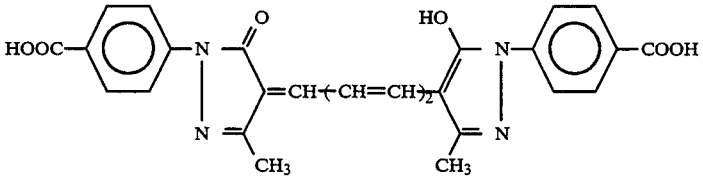
(Sc-4)
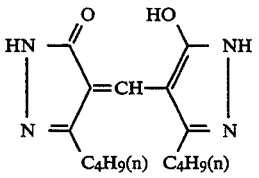

-continued
(Sc-5)
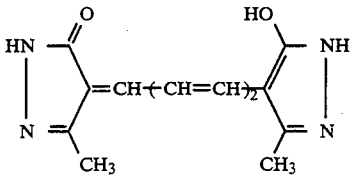
(Sc-6)
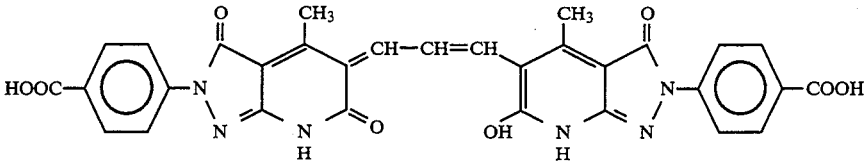
(Sc-7)
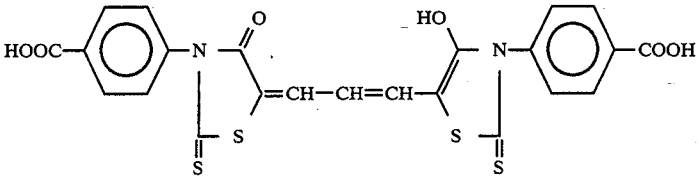
(Sc-8)
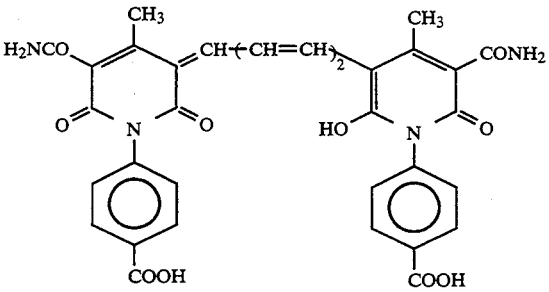
(Sc-9)
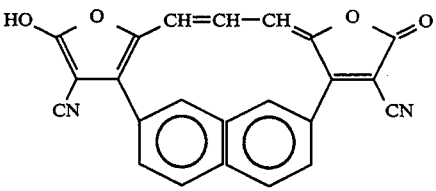
(Sc-10)
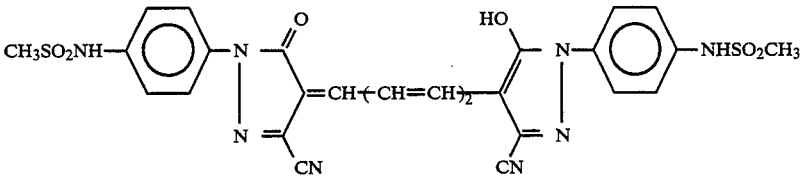
(Sc-11)
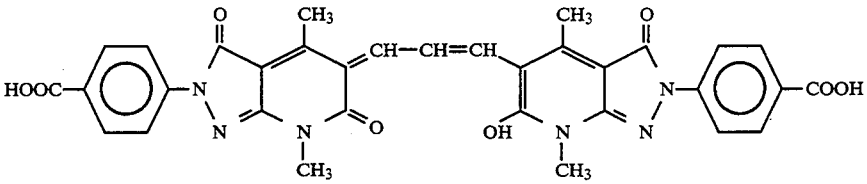
(Sd-1)
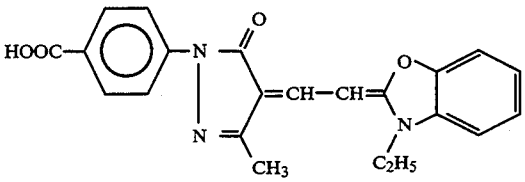

-continued
(Sd-2)
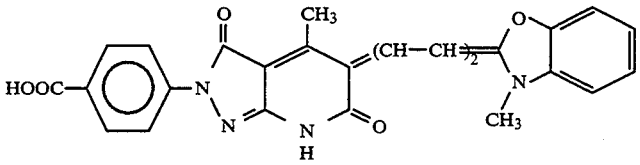
(Sd-3)
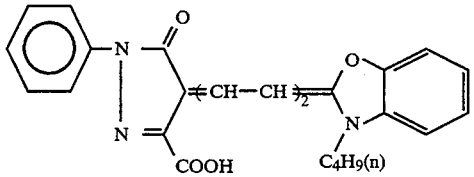
(Sd-4)
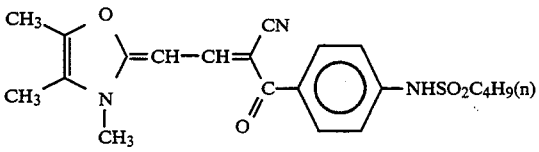
(Sd-5)
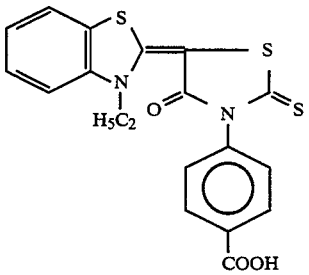
(Sd-6)
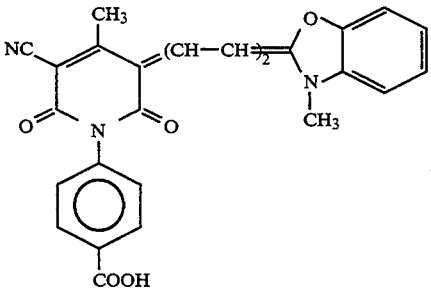
(Se-1)
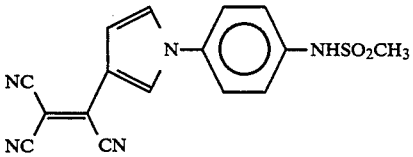
(Se-2)
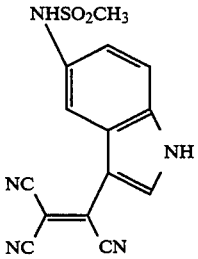

-continued (Se-3)

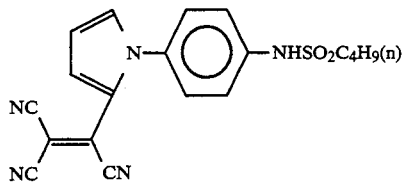

The solid fine particles of the above dyes can be prepared by precipitating the dye into the form of fine particles and/or by treating the dye in the presence of a dispersant by known grinding means, for example ball milling (for example, using a ball mill, a vibration ball mill, or a planetary ball mill), sand milling, colloid milling, jet milling, or roller milling; and in these means a solvent (e.g., water or an alcohol) may be or may not be present. Alternatively, after the dye is dissolved in an appropriate solvent, a non-solvent for the dye may then be added, to deposit fine crystalline particles of the dye, in which case a surface-active agent for the decomposition may be used. Otherwise, it is possible that the dye may first be dissolved by controlling the pH, and then the pH is changed, to crystallize the dye.

Preferably the solid fine-particulate dye is substantially insoluble in water at a pH of 6 or below, and it is substantially soluble in water at a pH of 8 or over.

The expression "the dye is substantially insoluble in water at a pH of 6 or below" means that the dye is insoluble to such a degree that a fine powder of the dye is kept in the dispersed state in a hydrophilic colloid having a pH of 6 or below; for example, in an aqueous gelatin solution having a pH of 6 or below. Preferably the solubility of the dye is such that the dye is soluble in an amount of 10 wt % or less, more preferably 5 wt % or less, in water having a pH of 6 at an ordinary temperature (24° C.).

The expression "the dye is substantially soluble in water at a pH of 8 or over" means that the dye is dissolved in water having a pH of 8 or over so that a fine powder of the dye cannot be kept in the dispersed state therein. Specifically the solubility of the dye is preferably such that the dye is soluble in an amount of 90 wt % or more, more preferably 95% or more, in water having a pH of 8 or over at an ordinary temperature. The solid dye used in the present invention may be soluble or insoluble in water at a pH of 7, but preferably it is insoluble substantially in water at a pH of 6 or below, and it is soluble substantially in water at a pH of 8 or over.

The dye fine particles in the gelatin dispersion system have an average particle diameter of, preferably 10 μm or less, more preferably 2 μm or less, and particularly preferably 0.5 μm or less; and in some cases it is further more preferable that the fine particles have an average particle diameter of 0.1 μm or less.

The compound represented by formula (Sa) can be added to any layer of the photographic constitutional layers.

However, to allow the effect of the colored layer to be exhibited favorably, preferably the layer containing the compound represented by formula (Sa) of the present invention which layer has absorption in the same wavelength region as that of the spectral sensitized region of each photosensitive layer, is applied adjacent to and below the said photosensitive layer. Herein the expression "is applied adjacent to and below the layer" means that the relevant layer is applied on the side of the support with respect to the photosensitive layer, and the expression may include a mode wherein the relevant layer is applied through some other hydrophilic colloid layer. More specifically, the expression "is applied below the photosensitive silver halide emulsion layer" includes a mode wherein the hydrophilic colloid layer containing the compound represented by formula (Sa) is applied on the emulsion layer through a thin non-photosensitive hydrophilic colloid layer (to which a coupler and the like may be added), but preferably the hydrophilic colloid layer containing the compound represented by formula (Sa) is applied below the photosensitive layer directly without interposing such a layer.

Although the total amount of the compound represented by formula (Sa) to be used may be arbitrarily decided depending on the amount required for the improvement of sharpness, preferably it is 10 to 800 mg/m$^2$, more preferably 10 to 400 mg/m$^2$, and most preferably 10 to 200 mg/m$^2$.

Now the compound represented by formula (I) is described in detail.

Particularly preferable compounds of those represented by formula (I) are compounds represented by the following formula (I-a):

formula (I-a)

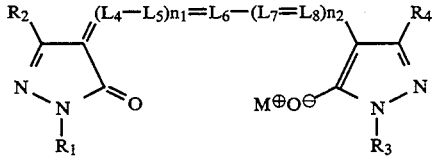

wherein $R_1$ and $R_3$ each represent an aliphatic group, an aromatic group, or a heterocyclic group, $R_2$ and $R_4$ each represent an aliphatic group, an aromatic group, —$OR_5$, —$COOR_5$, —$NR_5R_6$, —$CONR_5R_6$, —$NR_5CONR_5R_6$, —$SO_2R_7$, —$COR_7$, —$NR_6COR_7$, —$NR_6SO_2R_7$, a cyano group in which $R_5$ and $R_6$ each represent a hydrogen atom, an aliphatic group, or an aromatic group, $R_7$ represents an aliphatic group or an aromatic group, and $R_5$ and $R_6$ together and $R_6$ and $R_7$ together may bond to form a 5- or 6-membered ring, and $L_4$, $L_5$, $L_6$, $L_7$, $L_8$, $n_1$, $n_2$, and $M^{\oplus}$ have the same meanings as those in formula (I).

More particularly, the aliphatic group represented by $R_1$, $R_2$, $R_3$, $R_4$, $R_5$, $R_6$, and $R_7$ may be a straight-chain, branched, or cyclic alkyl group, aralkyl group, and alkenyl group, and examples are methyl, ethyl, n-butyl, benzyl, 2-sulfoethyl, 4-sulfobutyl, 2-sulfobenzyl, 2-carboxyethyl, carboxymethyl, trifluoromethyl, dimethylaminoethyl, and 2-hydroxyethyl.

Examples of the aromatic group represented by $R_1$, $R_2$, $R_3$, $R_4$, $R_5$, $R_6$, and $R_7$ are phenyl, naphthyl, 4-sulfophenyl, 3-sulfophenyl, 2,5-disulfophenyl, 4-carboxyphenyl, and 5,7-disulfo-3-naphthyl.

In particular, if $n_1=1$ or 2 and $n_2=0$, preferably each of the phenyl groups represented by $R_1$ and $R_2$ has two or more sulfonic acid groups.

The heterocyclic group represented by $R_1$ and $R_3$ represents a 5- or 6-membered nitrogen-containing heterocyclic group (including a condensed ring), such as 5-sulfopyridin-2-yl and 5-sulfobenzothiazol-2-yne.

The 5- or 6-membered ring formed by bonding $R_5$ and $R_6$ together and $R_6$ and $R_7$ together includes, for example, a pyrrolidine ring, a piperidine ring, a pyrrolidone ring, and a morpholine ring.

Examples of the dye represented by formula (I-a) are shown below, but the present invention is not restricted to them.

| NO. | $R_1$, $R_2$ | $R_3$, $R_4$ | $=(L_4-L_5)_{n1}=L_6-(L_7=L_8)_{n2}-$ | M |
|---|---|---|---|---|
| a-1 | 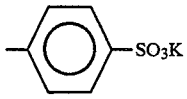 | $-CH_3$ | $=CH-$ | H |
| a-2 | 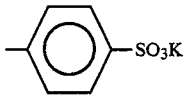 | $-CONHC_3H_7(n)$ | $=CH-$ | H |
| a-3 | 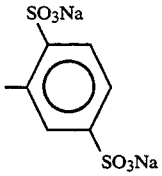 | $-OH$ | $=CH-CH=CH-$ | Na |
| a-4 | 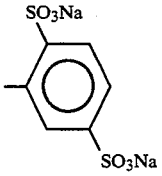 | $-CH_3$ | $=CH-$ | Na |
| a-5 | $-CH_2CH_2SO_3K$ | $-COOC_2H_5$ | $=CH-CH=CH-$ | H |
| a-6 | 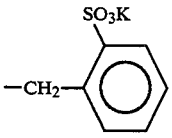 | $-CONHC_4H_9(n)$ | $=CH-CH=CH-$ | H |
| a-7 | $-CH_2CH_2SO_3K$ | $-COOK$ | $=CH\leftarrow CH=CH\rightarrow_2$ | H |
| a-8 | 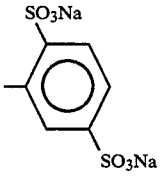 | $-COCH_3$ | $=CH\leftarrow CH=CH\rightarrow_2$ | Na |
| a-9 | 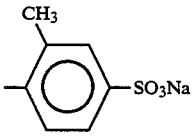 | $-CF_3$ | $=CH\leftarrow CH=CH\rightarrow_2$ | H |
| a-10 | 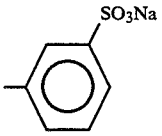 | $-NHCOCH_3$ | $=CH-CH=CH-$ | H |
| a-11 | 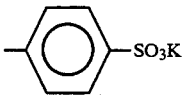 | $-COOC_2H_5$ | $=CH\leftarrow CH=CH\rightarrow_2$ | H |

-continued

| NO. | $R_1$, $R_2$ | $R_3$, $R_4$ | $=(L_4-L_5)_{n1}=L_6-(L_7=L_8)_{n2}-$ | M |
|---|---|---|---|---|
| a-12 | 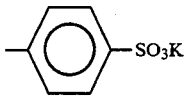 | $-COOK$ | $=CH-CH=CH-$ | H |
| a-13 | 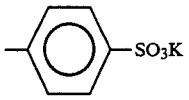 | $-NHCONHCH_3$ | $=CH-CH=CH-$ | H |
| a-14 | $-(CH_2)_4SO_3K$ | $-OH$ | $=CH-$ | H |
| a-15 | 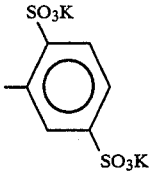 | $-COOK$ | $=CH-CH=CH-$ | K |
| a-16 | 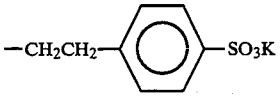 | $-C_6H_5$ | $=CH-CH=CH-$ | H |
| a-17 | 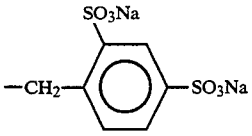 | $-COOC_2H_5$ | $=CH-(CH=CH)_2-$ | Na |
| a-18 | 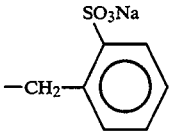 | $-CONHCH_2CH_2OH$ | $=CH-(CH=CH)_2-$ | H |
| a-19 | 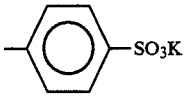 | $-CONHCH_2CH_2SO_3K$ | $=CH-(CH=CH)_2-$ | H |
| a-20 | $-(CH_2)_3SO_3K$ | $-CONHC_7H_{15}(n)$ | $=CH-CH=CH-$ | H |
| a-21 | $-CH_2COOK$ | $-COOK$ | $=CH-CH=CH-$ | K |
| a-22 | $-CH_2CH_2SO_3K$ | $-N(CH_3)_2$ | $=CH-(CH=CH)_2-$ | H |
| a-23 | $-(CH_2)_3SO_3K$ | $-CN$ | $=CH-(CH=CH)_2-$ | H |
| a-24 | 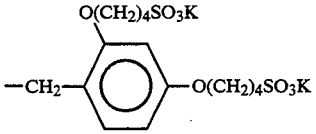 | $-CH_2Cl$ | $=CH-(CH=CH)_2-$ | H |
| a-25 | $-(CH_2)_2SO_3Na$ | $-OH$ | $=CH-(CH=CH)_2-$ | H |
| a-26 | 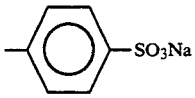 | $-CH_3$ | $=CH-C(CH_3)=CH-$ | Na |
| a-27 | 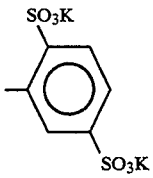 | $-COOC_2H_5$ | $=CH-(CH=CH)_2-$ | H |

-continued
| NO. | $R_1$, $R_2$ | $R_3$, $R_4$ | $=(L_4-L_5)_{n1}=L_6-(L_7=L_8)_{n2}-$ | M |
|---|---|---|---|---|
| a-28 | 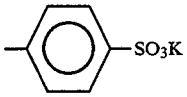 | $-CONHC_2H_5$ | $=CH-CH=CH-$ | H |
| a-29 | 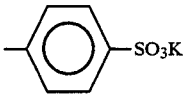 | $-NHCOC_3H_7(i)$ | $=CH-CH=CH-$ | H |
| a-30 | $-CH_2CH_2SO_3K$ | 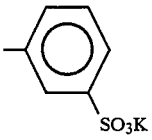 | $=CH-CH=CH-$ | H |
| a-31 | 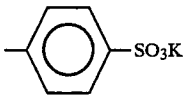 | $-CH_3$ | $=C(CH_3)-CH=CH-$ | H |
| a-32 | 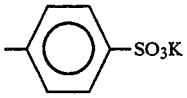 | $-{}^tC_4H_9$ | $=CH-CH=CH-$ | H |
| a-33 | 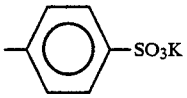 | $-CN$ | $=CH(-CH=CH-)_2$ | H |
| a-34 | 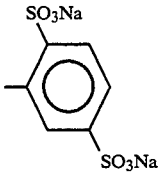 | $-COCH_3$ | $=CH-CH=C(CH_3)-CH=CH-$ | Na |
| a-35 | 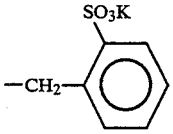 | $-COOK$ | $=CH(-CH=CH-)_2$ | H |
| a-36 | 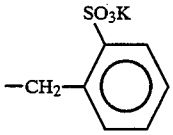 | $-COOK$ | $=CH-CH=CH-$ | H |
| a-37 | 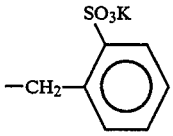 | $-CONHC_4H_9(i)$ | $=CH(-CH=CH-)_2$ | H |
| a-38 | 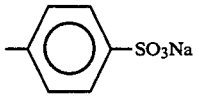 | $-NHSO_2CH_3$ | $=CH(-CH=CH-)_2$ | H |

-continued

| NO. | $R_1$, $R_2$ | $R_3$, $R_4$ | $=(L_4-L_5)_{n1}=L_6-(L_7=L_8)_{n2}-$ | M |
|---|---|---|---|---|
| a-39 | 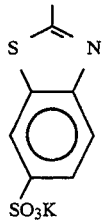 | —CN | $=CH-(CH=CH)_2-$ | H |
| a-40 | 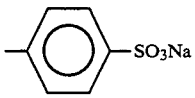 | $-OC_2H_5$ | $=CH-(CH=CH)_2-$ | H |
| a-41 | 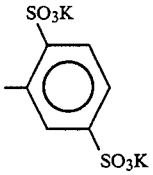 | —CN | $=CH-(CH=CH)_2-$ | H |
| a-42 | $-CH_3$ | 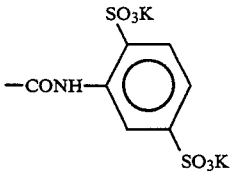 | $=CH-(CH=CH)_2-$ | H |

These dyes can be synthesized by methods described in British Patents Nos. 506,385, 1,177,429, 1,338,799, 1,385,371, 1,467,214, 1,433,102, and 1,553,516, and JP-A Nos. 85130/1973, 161233/1980, 20330/1977, 111640/1984, and 273527/1987.

Now the dye represented by formula (II) is described in detail.

The aryl group represented by $Ar_1$ and $Ar_2$ is preferably a phenyl group or a naphthyl group, which may have a substituent [e.g., a sulfonic acid group, a carboxylic acid group, a hydroxyl group, an alkyl group having 1 to 6 carbon atoms (e.g., methyl, ethyl, n-propyl, and isopropyl), an alkoxy group having 1 to 6 carbon atoms (e.g., methoxy, ethoxy, and butoxy), a carbamoyl group, a sulfamoyl group, a halogen atom (e.g., F, Cl, and Br), a cyano group, and a nitro group].

The heterocyclic group represented by $Ar_1$ and $Ar_2$ is preferably a 5- or 6-membered nitrogen-containing heterocyclic ring and examples are 1-(4-sulfophenyl)-3-carboxy-5-hydroxy-4-pyrazolyl, 1-(4-sulfophenyl)-3-methyl-5-hydroxy-4-pyrazolyl, 1-(2,5-disulfophenyl)-3-carboxyl-5-hydroxy-4-pyrazolyl, 1-carboxymethyl-3-carbamoyl-1,2-dihydro-6-hydroxy-4-methyl-2-oxopyridine, and 1-(2-sulfoethyl)-3-cyano-1,2-dihydro-6-hydroxy-4-methyl-2-oxopyridine.

Specific examples of the dye represented by formula (II) are shown below:

II-1

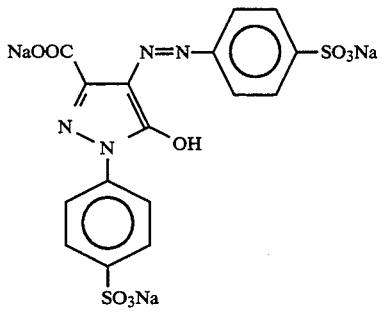

II-2

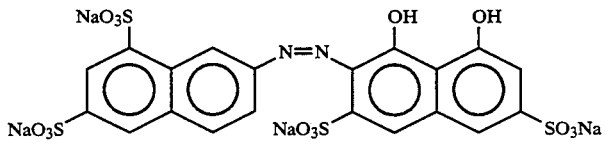

-continued
II-3
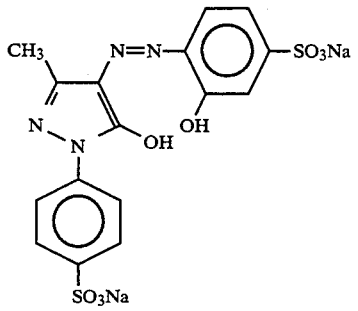
II-4
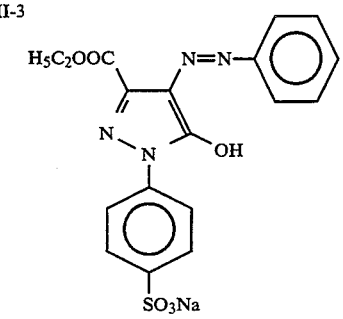
II-5
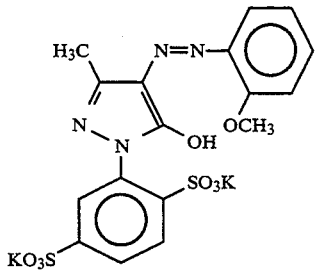
II-6
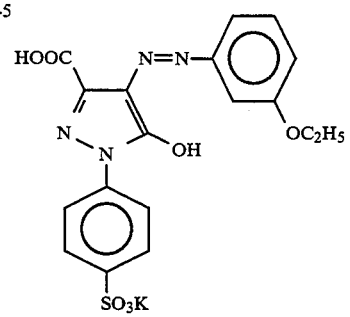
II-7
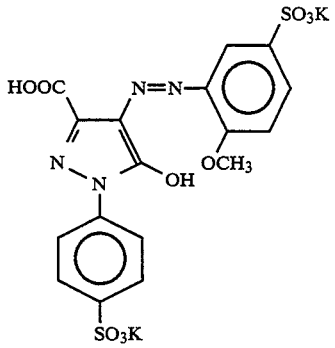
II-8
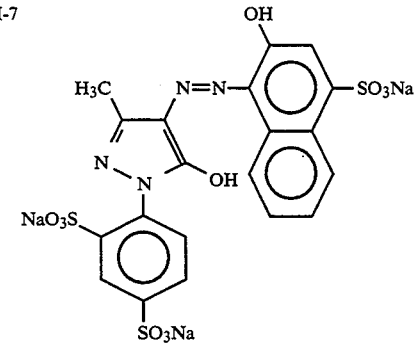
II-9
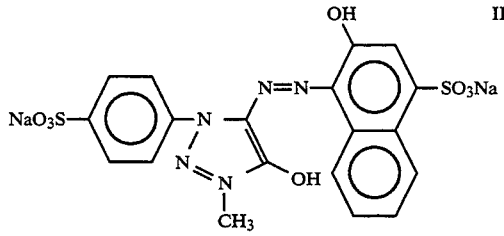
II-10
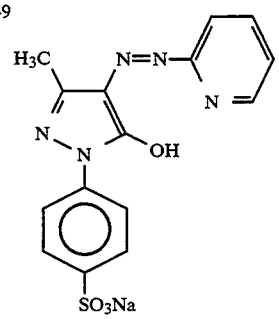
II-11
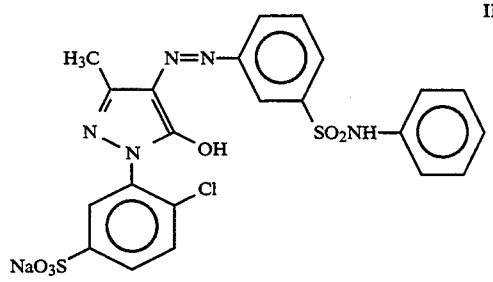
II-12
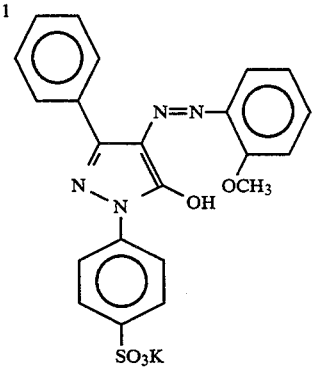

-continued
II-13
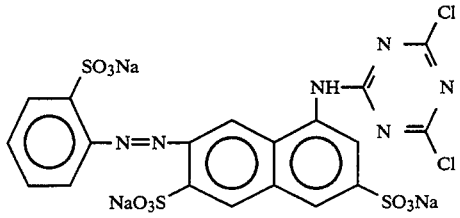
II-14
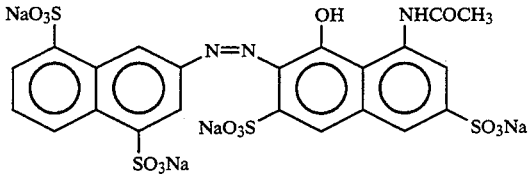
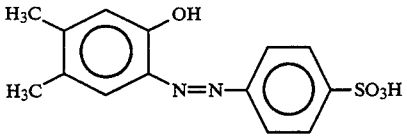
II-15
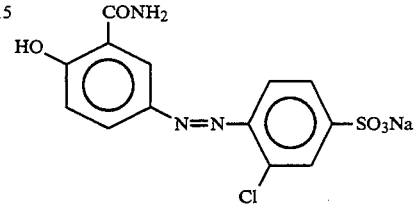
II-16
II-17
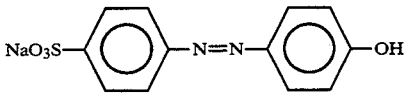
II-18
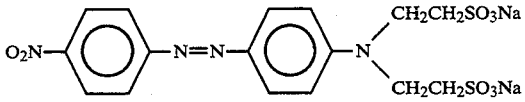
II-19
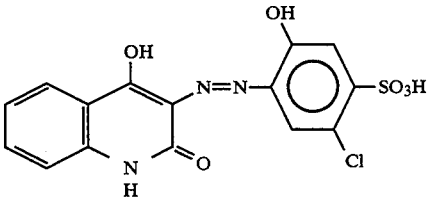
II-20
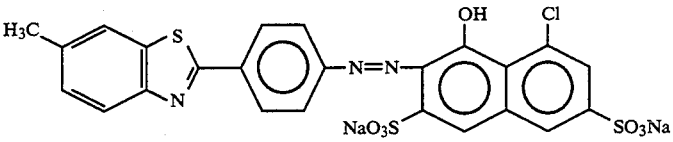
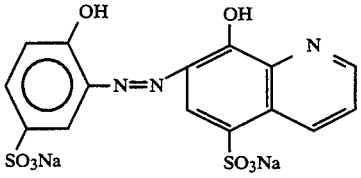
II-21
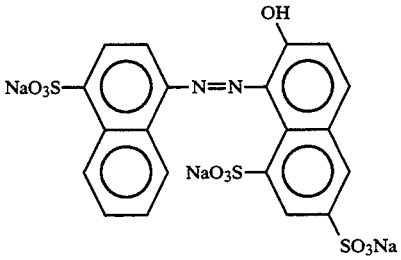
II-22

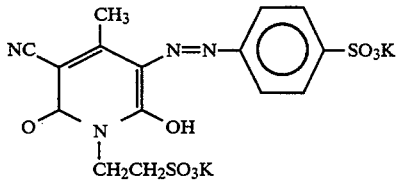

II-23

-continued

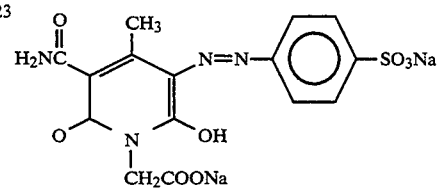

II-24

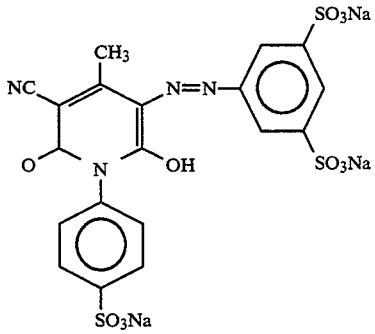

II-25

The dye represented by formula (II) can be synthesized by methods described in British Patent Nos. 575,691, 907,125, and 1,353,525.

Now the compound represented by formula (III) is described in detail.

In the formula, L and L′ each represent a substituted or unsubstituted methine group or a nitrogen atom and m′ is 0, 1, 2, or 3.

Z represents a group of nonmetal atoms required to form a pyrazolone nucleus, a hydroxypyridone nucleus, a barbituric acid nucleus, a thiobarbituric acid nucleus, a dimedone nucleus, an indane-1,3-dione nucleus, a rhodanine nucleus, a thiohydantoin nucleus, an oxazolidine-4-one-2-thion nucleus, a homophthalimido nucleus, a pyrimidine-2,4-dione nucleus, or a 1,2,3,4-tetrahydroquinoline-2,4-dione nucleus.

Y represents a group of nonmetal atoms required to form an oxazole nucleus, a benzoxazole nucleus, a naphthoxazole nucleus, a thiazole nucleus, a benzothiazole nucleus, a naphthothiazole nucleus, a benzoselenazole nucleus, a pyridine nucleus, a quinoline nucleus, a benzoimidazole nucleus, a naphthoimidazole nucleus, an imidazoquinoxaline nucleus, an indolenine nucleus, an isooxazole nucleus, a benzoisooxazole nucleus, a naphthoisooxazole nucleus, or an acridine nucleus, and Z and Y may further have a substituent.

Specific examples of the compound represented by formula (III) are given below:

III-1

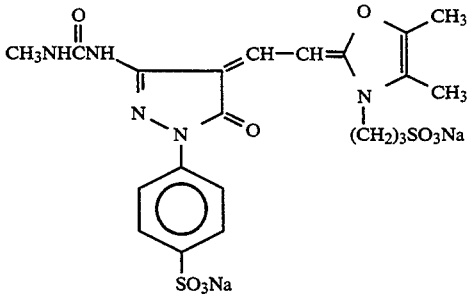

-continued

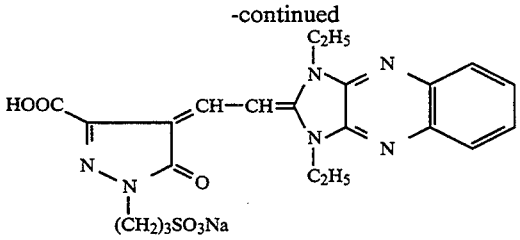

III-2

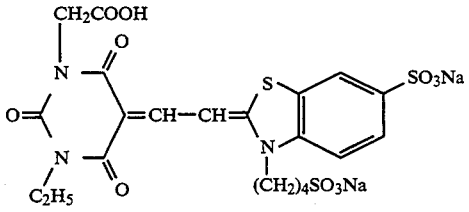

III-3

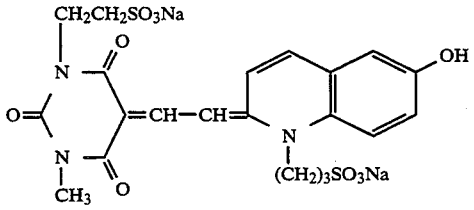

III-4

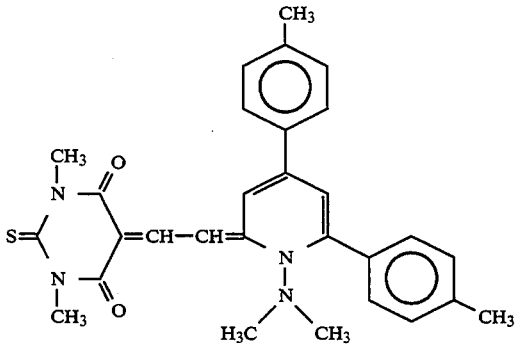

III-5

-continued

III-6

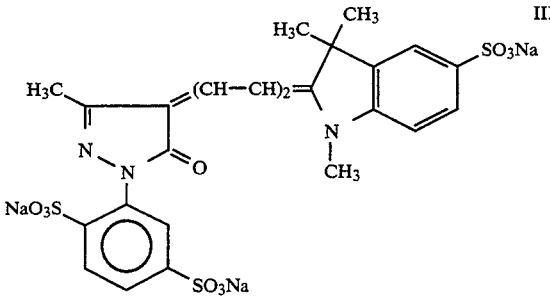

III-7

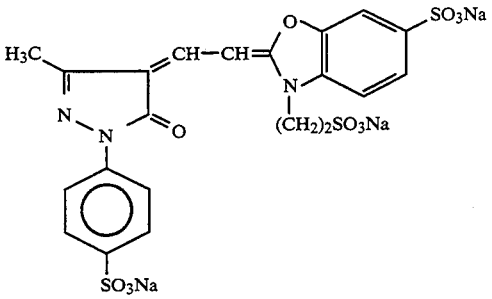

III-8

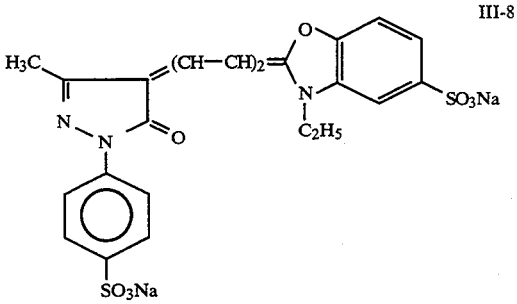

III-9

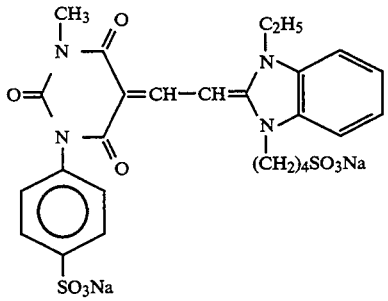

III-10

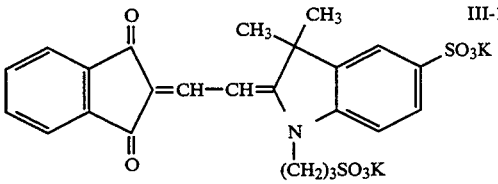

III-11

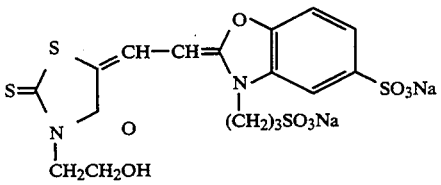

-continued

III-12

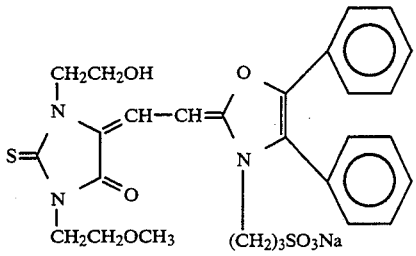

III-13

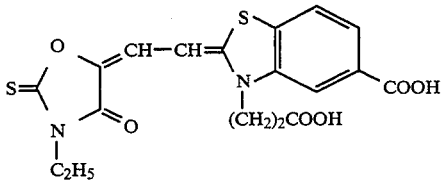

III-14

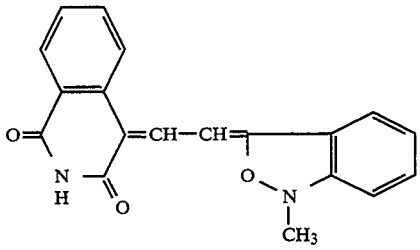

III-15

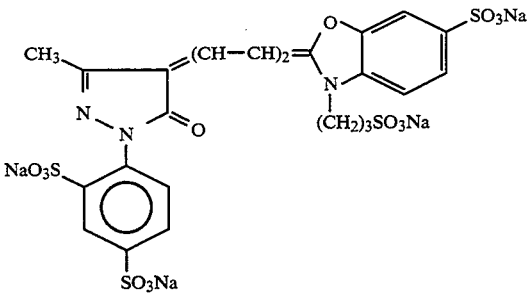

III-16

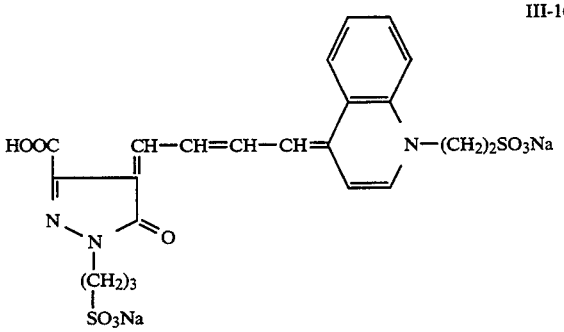

The compounds represented by formulas (I), (II), and (III) may be used alone or in combination. The layers to which these dyes are added are not particularly restricted, and the dyes may be added, for example, to the layer between the lowermost photosensitive layer and the support, to photosensitive layers, to intermediate layers, to protective layers, and to the layer between the protective layer and the uppermost photosensitive layer.

The dye for attaining this purpose is selected from those which substantially do not spectral sensitize the silver halide. As the method for adding these dyes, a conventional method can be used, and for example the dye may be added first by dissolving it in water or an alcohol, such as methanol.

Although the total amount of the compounds represented by formulae (I), (II), and (III) to be used in the photographic material may be arbitrarily decided depending on the amount required for the improvement of sharpness, preferably it is 10 to 1,000 mg/m$^2$, more preferably 10 to 500 mg/m$^2$, and most preferably 10 to 200 mg/m$^2$.

In the present invention, as hydrophilic colloid (binder) constituting hydrophilic colloid layers, silver halide emulsion layers, and nonphotosensitive intermediate layers preferably gelatin can be used. If necessary, some other hydrophilic colloid can be used instead of a part of gelatin in an arbitrary ratio to gelatin.

Examples of the other hydrophilic colloid which can be mentioned include a gelatin derivative, a graft copolymer of gelatin with other polymer, a protein such as albumin and casein, a cellulose derivative (e.g., hydroxyethyl-cellulose, carboxymethyl-cellulose, and cellulose sulfate), a succharide such as sodium alginate and starch derivative, poly(vinyl alcohol), a partially acetalized poly(vinyl alcohol), poly(N-vinyl pyrrolidone), polyacrylic acid, polymethacrylic acid, polyacryl amide, a synthetic polymer including polymer in wide range such as polyvinyl imidazole and polyvinyl pyrazole.

Although gelatin is advantageously used as a binder or protective colloid for the photographic material according to the present invention, hydrophilic colloids other than gelatin also can be used alone or in combination with gelatin. A low-calcium gelatin having calcium content of preferably 800 ppm or less, more preferably 200 ppm or less, is preferably used. Preferably the total amount of calcium contained in hydrophilic colloid layers of the photographic material is 10 mol % or less per total coating amount of silver, in view of improving the non-coloring property of the white background. Further, in order to prevent various molds and bacteria from propagating in the hydrophilic colloid layer which cause the deterioration of image, an antifungal agent described, for example, in JP-A No. 271247/1988 is preferably used.

Further, preferably the swelling ratio of the photographic constitutional layers on the silver halide emulsion-coated surface is 2.0 or less, in view of maintaining the non-coloring property of the white background, and also for maintaining the coated film strength during the processing in order to prevent the occurrence of scratches on the coated film during the processing. The swelling ratio is determined by measuring the dried film thickness ($L_D$) of the photographic constitutional layers on the silver halide emulsion-coated surface of the reflective support, utilizing a optical microscope, and the wet film thickness ($L_W$) when the photographic material is immersed into the developer in the conditions of the same temperature and time as the actual development. That is, the swelling ratio (B) is represented by $L_W/L_D$. Preferable examples of hardening agents to adjust the swelling ratio to 2.0 or less are an activated halide compound, such as 2,4-dichloro-6-hydroxy-s-triazine sodium salt, and an activated vinyl series compound, such as 1,3,5-triacryloyl-hexahydro-s-triazine, 1,3,5-trivinylsulfonyl-hexahydro-s-triazine, bis(vinylsulfonylmethyl)propanol-2, and bis(α-vinylsulfonylacetoamide)ethane.

In the present invention, the total amounts of gelatin in photographic constitutional layers is 8.5 mg/m$^2$ or less, preferably 8.0 mg/m$^2$ or less, more preferably 7.5 mg/m$^2$ or less. The lowest limit of this total amounts of gelatin is not particularly restricted, but it is preferably 5.0 mg/m$^2$ or more, in order to prevent oils in the photographic constitutional layers from soaking out. The excess amount of total gelatin is not preferable in view of improvement of sharpness and rapid processing.

In the photographic material of the present invention that can satisfy the sharpness of image and non-coloring property of the white background and is suitable for a rapid processing, it is necessary to use a so-called high-silver-chloride emulsion having a high silver chloride content. That is, it is necessary that the silver chloride content of the high-silver-chloride emulsion is 90 mol % or more, more preferably 95 mol % or more.

The color photographic material in the present invention can be formed by applying at least one yellow-color-forming silver halide emulsion layer, at least one magenta-color-forming silver halide emulsion layer, and at least one cyan-color-forming silver halide emulsion layer on a support having a reflective layer. In a usual color photographic printing paper, by adding color couplers that can form dyes having relationships complementary to lights to which the silver halide emulsions are sensitive, the color can be reproduced by the subtractive color process. An usual color photographic printing paper can be formed in such a manner that silver halide emulsion grains are spectrally sensitized with a blue-sensitive spectral sensitizing dye, a green-sensitive spectral sensitizing dye, and a red-sensitive spectral sensitizing dye, in the order of the above color-forming layers, and they are applied on a support in the above-stated order. However, the order may be different. In view of the rapid processing, there is a case wherein a photosensitive layer containing silver halide grains having the greatest average grain size is preferably the uppermost layer; or in view of the preservability under exposure to light, there is a case wherein the lowermost layer is preferably a magenta color-forming photosensitive layer.

The photosensitive layers and the hues that will be formed by color forming may be formed not to have the above correspondence, and at least one infrared photosensitive silver halide emulsion layer can be used.

As the silver halide grains for use in the present invention, silver chloride, silver bromide, silver (iodo)-chlorobromide, and silver iodobromide can be mentioned. Particularly, in the present invention, in order to shorten the development processing time, silver chlorobromide grains or silver chloride grains substantially free from silver iodide can preferably be used. Herein the expression "substantially free from silver iodide" means that the silver iodide content is 1 mol % or less, preferably 0.2 mol % or less. On the other hand, for the purpose of increasing high-intensity sensitivity, spectral sensitization sensitivity, or long-term stability of the photographic material, there is a case wherein high-silver-chloride grains containing 0.01 to 3 mol % of silver iodide on the emulsion surface is preferably used as described in JP-A No. 84545/1991. Although the halogen composition of the emulsion may be different or uniform from grain to grain, when an emulsion having a halogen composition uniform from grain to grain is used, the properties of the grains can be easily made homogeneous. With respect to the halogen composition distribution in the silver halide emulsion grains, for example, grains having the so-called uniform-type structure, wherein the halogen composition is uniform throughout the grains; grains having the so-called layered-type structure, wherein the halogen composition of the core in the silver halide grains is different from that of the shell (consisting of a layer or layers) surrounding the core; or grains having a structure wherein non-layered parts different in halogen composition are present in the grains or on the surface of the grains (if the non-layered parts different in halogen composition are present on the surface of the grains, they may be joined to the edges, corners, or planes of grains) may suitably be chosen. To secure a high sensitivity, it is more advantageous to use one of the latter two than to use grains having a uniform-type structure and the latter two are also preferable in view of pressure-resistance properties. If the silver halide grains have the above structure, the boundary of parts different in halogen composition may be a clear boundary, an obscure boundary formed by a mixed crystal due to the difference of the composition, or a boundary wherein the structure is continuously changed positively.

In such high-silver-chloride emulsion, preferably the silver bromide localized phase is layered or non-layered in the silver halide grains and/or on the surface of the grains as described above. The halogen composition of the above localized phase preferably has a silver bromide content of at least 10 mol %, more preferably the content is more than 20 mol % but 100 mol % or less. The silver bromide content of the silver bromide localized phase can be analyzed, for example, by using the X-ray diffraction method (described, for example, in *Shin-jikkenkagaku-koza* 6, *Kozokaiseki,* edited by Nihonkagakukai, published by Maruzen). The localized phase may be present in the grains or on the edges, corners, or planes of the grain surface and one preferable example is one wherein the localized phase is grown epitaxially on the corners of the grains.

For the purpose of decreasing the replenishment rate of the development processing solution, it is effective to increase further the silver chloride content of the silver halide emulsion. In that case, an emulsion comprising nearly pure silver chloride, for example an emulsion having a silver chloride content of 98 to 100 mol %, is also preferably used.

The average grain size of the silver halide grains contained in the silver halide emulsion used in the present invention (the average grain size is calculated in such a way that, by assuming the diameters of circles equivalent to the projected areas of the grains to be the grain sizes, its number average is designated as the average grain size) is preferably 0.1 to 2 μm.

The grain size distribution of them is preferably a monodisperse distribution wherein the deviation coefficient (which is obtained by dividing the standard deviation of the grain size distribution by the average grain size) is preferably 20% or less, desirably 15% or less, and more preferably 10% or less. At that time, for the purpose of obtaining a wide latitude, it is also preferably carried out that such monodisperse emulsions are blended in one layer to be used or are applied in layers.

With respect to the form of the silver halide grains contained in the photographic emulsion, a regular crystal form, such as a cubic form, a tetradecahedral form, or an octahedral form, an irregular crystal form, such as a sphere form or a tabular form, or a composite of these can be used. Also a mixture of various crystal forms can be used. In the present invention, it is desired that, out of these, the above regular crystal form amounts to 50% or more, preferably 70% or more, and more preferably 90% or more, in the grains.

Besides these, an emulsion wherein tabular grains having an average aspect ratio (the diameter in terms of circles/thickness) of 5 or more, preferably 8 or more, amount to over 50% in all the grains in terms of projected areas can be preferably used.

The silver chlorobromide emulsion for use in the present invention can be prepared by processes described, for example, by P. Glafkides in *Chimie et Phisique Photographique* (published by Paul Montel, 1967), by G. F. Duffin in *Photographic Emulsion Chemistry* (published by Focal Press, 1966), and by V. L. Zelikman et al. in *Making and Coating Photographic Emulsion* (published by Focal Press, 1964). That is, any of the acid process, the neutral process, the ammonia process, etc., can be used, and in order to react a soluble silver salt and a soluble halide, for example, any of the single-jet process, the double-jet process, or a combination of these can be used. A process of forming grains in an atmosphere having excess silver ions, the so-called reverse precipitation process, can also be used. A process wherein the silver ion concentration (pAg) in the liquid phase, in which a silver halide is to be formed, is kept constant, that is, the so-called controlled double-jet process, is more preferably used as one type of the double-jet process. According to the controlled double-jet process, a silver halide emulsion wherein the crystal form of the silver halide is regular and the grain sizes are nearly monodisperse can be obtained.

The localized phase of the silver halide grains utilized in the present invention or its substrate preferably contains different metal ions or their complex ions. Preferable metal ions are selected from ions of metals belonging to Groups VIII and IIb of the Periodic Table, their complex ions, lead ions, and thallium ions. Mainly, in the localized phase, ions selected from iridium ions, rhodium ions, and iron ions, and their complex ions, can be used; and mainly, in the substrate, ions of metals selected from osmium, iridium, rhodium, platinum, ruthenium, palladium, cobalt, nickel, iron, etc., and their complex ions can be used in combination. The localized phase and the substrate may be different in their kind of the metal ions and the concentration of the metal ions. Several of these metals can be used. Particularly, it is preferable to allow an iron compound and an iridium compound to be present in the silver bromide localized phase.

These metal-ion-providing compounds are incorporated in the localized phase of the silver halide grains utilized in the present invention and/or some other grain part (substrate) at the time of the formation of silver halide grains by means, for example, of adding them into an aqueous gelatin solution, an aqueous halide solution, an aqueous silver salt solution, or other aqueous solution serving as a dispersing medium, or by adding silver halide fine grains already containing the metal ions and dissolving the fine grains.

The metal ions to be used in the present invention may be incorporated in emulsion grains before, during, or immediately after the formation of the grains, which time will be selected depending on their position in the grains.

Generally the silver halide emulsion used in the present invention is chemically and spectrally sensitized.

As the chemical sensitization, that which uses a chalcogen sensitizer (specifically, sulfur sensitization, which typically includes the addition of an unstable sulfur compound; selenium sensitization, which uses a selenium compound; or tellurium sensitization, which uses a tellurium compound), noble metal sensitization, typically such as gold sensitization, and reduction sensitization can be used alone or in combination. With respect to compounds used in chemical sensitization, those described in JP-A No. 215272/1987, page 18 (the right lower column) to page 22 (the right upper column), are preferably used.

The emulsion used in the present invention is a so-called surface latent image-type emulsion, wherein a latent image is mainly formed on the grain surface.

To the silver halide emulsion for use in the present invention, various compounds or their precursors can be added for the purpose of preventing fogging during the production process, storage, or the processing of the photographic material, or for the purpose of stabilizing the photographic performance. Specific examples of these compounds are described in the above-mentioned JP-A No. 215272/1987, pages 39 to 72, which compounds are preferably used. Further, 5-arylamino-1,2,3,4-thiatriazole compounds (whose aryl residues have at least one electron-attracting group respectively) described in EP 0447647 can also be preferably used.

The spectral sensitization is carried out for the purpose of spectrally sensitizing emulsions in each layer of the photographic material of the present invention to a desired wavelength region of light.

In the photographic material of the present invention, as spectral sensitizing dyes used for spectral sensitization for blue, green, and red regions, for example, those described by F. M. Harmer in *Heterocyclic compounds-Cyanine dyes and related compounds* (published by John Wiley & Sons [New York, London], 1964) can be mentioned. As specific examples of the compounds and the spectral sensitization, those described in the above-mentioned JP-A No. 215272/1987, page 22 (the right upper column) to page 38, are preferably used. As the red-sensitive spectral sensitizing dyes for high-silver-chloride emulsion grains high in silver chloride content, spectral sensitizing dyes described in JP-A No. 123340/1991 are very preferable in view, for example, of the stability, the strength of the adsorption, and the temperature dependence of the exposure.

In the case wherein the photographic material of the present invention is to be spectral sensitized effectively in the infrared region, sensitizing dyes described in JP-A No. 15049/1991, page 12 (the left upper column) to page 21 (the left lower column); in JP-A No. 20730/1991, page 4 (the left lower column) to page 15 (the left lower column); in EP-0,420,011, page 4, line 21, to page 6, line 54; in EP-0,420,012, page 4, line 12, to page 10, line 33; in EP-0,443,466; and in U.S. Pat. No. 4,975,362 are preferably used.

To incorporate these spectral sensitizing dyes into the silver halide emulsion, they may be directly dispersed into the emulsion, or after they are dissolved in a solvent or a combination of solvents, such as water, methanol, ethanol, propanol, methyl Cellosolve, and 2,2,3,3-tetrafluoropropanol, the solution may be added to the emulsion. Also the spectral sensitizing dye may be formed together with an acid or a base into an aqueous solution, as described in JP-B ("JP-B" means examined Japanese patent publication) Nos. 23389/1969, 27555/1969, and 22089/1982, or the spectral sensitizing dye may be formed together with a surface-active agent into an aqueous solution or a colloid dispersion, as described in U.S. Pat. Nos. 3,822,135 and 4,006,025, and the obtained aqueous solution or colloid dispersion may be added to the emulsion. Also after the spectral sensitizing dye may be dissolved in a solvent substantially immiscible with water, such as phenoxyethanol, the solution is dispersed in water or a hydrophilic colloid and is added to the emulsion. The spectral sensitizing dye may be directly dispersed in a hydrophilic colloid, as described in JP-A Nos. 102733/1978 and 105141/1983, and the dispersion is added to the emulsion. The time at which the dispersion or solution is added to the emulsion may be at any stage of the preparation of the emulsion, which time is hitherto known and considered useful. That is, the dispersion or the solution may be added before or during the formation of grains of the silver halide emulsion, or during the period from immediately after the formation of grains before entering the washing step, or before or during the chemical sensitization, or during the period from immediately after the chemical sensitization till the cooling and solidifying of the emulsion, or at the time the coating solution is prepared. Although generally the addition of the dispersion or the solution is carried out in a period after the completion of the chemical sensitization and before the application, the dispersion or the solution may be added together with a chemical sensitizer to carry out spectral sensitization and chemical sensitization at the same time, as described in U.S. Pat. Nos. 3,628,969 and 4,225,666; or the addition may be carried out before chemical sensitization, as described in JP-A No. 113928/1983; or the dispersion or the solution may be added before the completion of the precipitation of the silver halide grains, to allow the spectral sensitization to start. Further, as taught in U.S. Pat. No. 4,225,666, it is possible that the spectrally sensitizing dye may be divided into two portions and added: one portion is added prior to chemical sensitization, and the other is added after the chemical sensitization. As shown in U.S. Pat. No. 4,183,756, the dispersion or the solution may be added at any time during the formation of silver halide grains. In particular, the sensitizing dye is preferably added before the washing step of the emulsion or before chemical sensitization of the emulsion.

The amount of these spectral sensitizing dyes to be added varies widely depending on the case and is preferably in the range of $0.5\times10^{-6}$ to $1.0\times10^{-2}$ mol, more preferably $1.0\times10^{-6}$ to $5.0\times10^{-3}$ mol, per mol of the silver halide.

In the present invention, if a sensitizing dye has spectral sensitization sensitivity particularly in from the red region to the infrared region, it is preferable to use additionally a compound described in JP-A No. 157749/1990, page 13 (the right lower column) to page 22 (the right lower column). By using these compounds, the preservability of the photographic material, the stability of the processing, and the supersensitizing effect can be increased specifically. In particular, additional use of compounds of general formulae (IV), (V), and (VI) in that patent is particularly preferable. These compounds are used in an amount of $0.5\times10^{-5}$ mol to $5.0\times10^{-2}$ mol, preferably $5.0\times10^{-5}$ mol to $5.0\times10^{-3}$ mol, per mol of the silver halide and the advantageous amount is in the range of 0.1 to 10,000, preferably 0.5 to 5,000, times one mol of the sensitizing dye.

The photosensitive material according to the present invention may be exposed to light by a visible light or by an infrared light. As a method for exposing to light, besides a print system using usual negative printers, it is preferably used for digital scanning exposure that uses monochromatic high-density light, such as a second harmonic generating light source (SHG) that comprises a combination of a nonlinear optical crystal with a semiconductor laser or a solid state laser using a semiconductor laser as an excitation light source, a gas laser, a light-emitting diode, or a semiconductor laser. To make the system compact and inexpensive, it is preferable to use a semiconductor laser or a second harmonic generating light source (SHG) that comprises a combination of a nonlinear optical crystal with a semiconductor laser or a solid state laser. Particularly, to design an apparatus that is compact, inexpensive, long in life, and high in stability, the use of a semiconductor laser is preferable, and it is desired to use a semiconductor laser for at least one of the exposure light sources.

If such a scanning exposure light source is used, the spectral sensitivity maximum of the photographic material of the present invention can arbitrarily be set by the wavelength of the light source for the scanning exposure to be used. In an SHG light source obtained by combining a nonlinear optical crystal with a semiconductor laser or a solid state laser that uses a semiconductor laser as an excitation light source, since the emitting wavelength of the laser can be halved, blue light and green light can be obtained. Therefore, the spectral sensitivity maximum of the photographic material can be present in each of the blue region, the green region, and the red region. In order to use a semiconductor laser as a light source to make the apparatus inexpensive, high in stability, and compact, preferably each of at least two layers have a spectral sensitivity maximum at 670 nm or over. This is because the emitting wavelength range of the available, inexpensive, and stable III–V group semiconductor laser is present now only in from the red region to the infrared region. However, on the laboratory level, the oscillation of a II–VI group semiconductor laser in the green or blue region is confirmed and it is highly expected that these semiconductor lasers can be used inexpensively and stably if production technique for the semiconductor lasers is developed. In that event, the necessity that each of at least two layers has a spectral sensitivity maximum at 670 nm or over becomes lower.

In such scanning exposure, the time for which the silver halide in the photographic material is exposed is the time for which a certain very small area is required to be exposed. As the very small area, the minimum unit that controls the quantity of light from each digital data is generally used and is called a picture element. Therefore, the exposure time per picture element is changed depending on the size of the picture element. The size of the picture element is dependent on the density of the picture element, and the actual range is from 50 to 2,000 dpi. If the exposure time is defined as the time for which a picture size is exposed with the density of the picture element being 400 dpi, preferably the exposure time is $10^{-4}$ sec or less, more preferably $10^{-6}$ sec or less. Further, the exposure time is preferably $10^{-10}$ to $10^{-4}$ sec, more preferably $10^{-10}$ to $10^{-6}$ sec.

In the photographic material according to the present invention, a colored layer which can be decolored by processing may be used. Herein, the term "colored layer which can be decolored by processing" means such a layer wherein the coloring agent contained therein does not substantially diffuse or migrate to other layers, but is immobilized therein at the time of coating. This colored layer may be arranged in contact with the emulsion layer directly or through an intermediate layer containing a processing color-mix inhibitor, such as gelatin and hydroquinones. This colored layer is preferably located under the emulsion layer (on the side of the support) that will form a primary color which is the same as that of the colored layer. Further, this colored layer may contain a white pigment, and the colored layer is preferably located above a non-photosensitive hydrophilic colloid layer containing a white pigment, more preferably is provided above the non-photosensitive hydrophilic colloid layer containing a white pigment. Colored layers corresponding to respective primary colors may all be arranged, or only some of them may be arbitrarily selected and arranged. A colored layer that has been colored to correspond to several primary color regions can also be arranged. The optical reflection density of the colored layer is preferably such that the value of the optical density at the wavelength at which the optical density is highest in the wavelength region of 400 nm to 700 nm is 0.2 to 3.0, more preferably 0.5 to 2.5, and particularly preferably 0.8 to 2.0. To form the colored layer, conventionally known methods can be applied. For instance, there can be mentioned a method wherein an anionic dye is mordanted to a cationic polymer, a method wherein a dye is adsorbed to fine particles of a silver halide and is fixed into a layer, and a method wherein colloidal silver is used. For example, a method wherein an anionic dye is mordanted to a cationic polymer is described in JP-A No. 84637/1990, pages 18 to 26. Methods for preparing colloidal silver as a light-absorbing agent are described in U.S. Pat. Nos. 2,688,601 and 3,459,563.

An exposed photographic material can be subjected to conventional color development processing, and generally the developing treatment may be carried out within 1 minute and 30 seconds, with a standard being about 45 seconds. Further, a super rapid processing such as 20 seconds or less may be possible. With respect to the silver halide color photographic material of the present invention, it is preferable that after color-developing it is bleach-fixed for the purpose of rapid processing. Particularly, when the above high-silver-chloride emulsion is used, the pH of the bleach-fix solution is preferably about 6.5 or below, more preferably 6 or below, for the purpose, for example, of accelerating desilvering.

As the silver halide emulsion to be applied to the photographic material of the present invention and the other materials (e.g., additives) and the photographic constitutional layers (including the arrangement of the layers) to be applied thereto and the processing method and additives used in the processing of the photographic material of the present invention, those described in the below-mentioned patent gazettes, particularly in European Patent EP 0,355,660A2 (JP-A No. 139544/1990), are preferably used.

| Element constituting photographic material | JP-A No. 215272/1987 | JP-A No. 33144/1990 | EP 0,355,660A2 |
|---|---|---|---|
| Silver halide emulsion | p.10 upper right column line 6 to p.12 lower left column line 5, and p.12 lower right column line 4 from the bottom to p.13 upper left column line 17 | p.28 upper right column line 16 to p.29 lower right column line 11 and p.30 lines 2 to 5 | p.45 line 53 to p.47 line 3 and p.47 lines 20 to 22 |
| Solvent for silver halide | p.12 lower left column lines 6 to 14 and p.13 upper left column line 3 from the bottom to p.18 lower left column last line | — | — |
| Chemical sensitizing agent | p.12 lower left column line 3 from the bottom to lower right column line 5 from the bottom and p.18 lower right column line 1 to p.22 upper right column line 9 from the bottom | p.29 lower right column line 12 to last line | p.47 lines 4 to 9 |
| Spectral sensitizing agent (method) | p.22 upper right column line 8 from the bottom to p.38 last line | p.30 upper left column lines 1 to 13 | p.47 lines 10 to 15 |
| Emulsion stabilizer | p.39 upper left column line 1 to p.72 upper right column last line | p.30 upper left column line 14 to upper right column line 1 | p.47 lines 16 to 19 |
| Developing accelerator | p.72 lower left column line 1 to p.91 upper right column line 3 | — | — |
| Color coupler (Cyan, Magenta, and Yellow coupler) | p.91 upper right column line 4 to p.121 upper left column line 6 | p.3 upper right column line 14 to p.18 upper left column last line and p.30 upper right column line 6 to p.35 lower right column line 11 | p.4 lines 15 to 27, p.5 line 30 to p.28 last line, p.45 lines 29 to 31 and p.47 line 23 to p.63 line 50 |
| Color Formation-strengthen agent | p.121 upper left column line 7 to p.125 upper right column line 1 | — | — |
| Ultraviolet absorbing agent | p.125 upper right column line 2 to p.127 lower left column last line | p.37 lower right column line 14 to p.38 upper left column line 11 | p.65 lines 22 to 31 |
| Discoloration inhibitor (Image-dye stabilizer) | p.127 lower right column line 1 to p.137 lower left column line 8 | p.36 upper right column line 12 to p.37 upper left column line 19 | p.4 line 30 to p.5 line 23, p.29 line 1 to p.45 line 25 p.45 lines 33 to 40 and p.65 lines 2 to 21 |
| High-boiling and/or low-boiling solvent | p.137 lower left column line 9 to p.144 upper right column last line | p.35 lower right column line 14 to p.36 upper left column line 4 from the bottom | p.64 lines 1 to 51 |
| Method for dispersing additives for photograph | p.144 lower left column line 1 to p.146 upper right column line 7 | p.27 lower right column line 10 to p.28 upper left column last line and p.35 lower right column line 12 to p.36 upper right column line 7 | p.63 line 51 to p.64 line 56 |
| Film Hardener | p.146 upper right column line 8 to p.155 lower left column line 4 | — | — |
| Developing Agent precursor | p.155 lower left column line 5 to p.155 lower right column line 2 | — | — |
| Compound releasing development inhibitor | p.155 lower right column lines 3 to 9 | — | — |
| Support | p.155 lower right column line 19 to p.156 upper left column line 14 | p.38 upper right column line 18 to p.39 upper left column line 3 | p.66 line 29 to p.67 line 13 |
| Constitution of photosensitive layer | p.156 upper left column line 15 to p.156 lower right column line 14 | p.28 upper right column lines 1 to 15 | p.45 lines 41 to 52 |
| Dye | p.156 lower right column line 15 to p.184 lower right column last line | p.38 upper left column line 12 to upper right column line 7 | p.66 lines 18 to 22 |
| Color-mix inhibitor | p.185 upper left column line 1 to p.188 lower | p.36 upper right column lines 8 to 11 | p.64 line 57 to p.65 line 1 |

-continued

| Element constituting photographic material | JP-A No. 215272/1987 | JP-A No. 33144/1990 | EP 0,355,660A2 |
|---|---|---|---|
| | right column line 3 | | |
| Gradation controller | p.188 lower right column lines 4 to 8 | — | — |
| Stain inhibitor | p.188 lower right column line 9 to p.193 lower right column line 10 | p.37 upper left column last line to lower right column line 13 | p.65 line 32 to p.66 line 17 |
| Surface-active agent | p.201 lower left column line 1 to p.210 upper right column last line | p.18 upper right column line 1 to p.24 lower right column last line and p.27 lower left column line 10 from the bottom to lower right column line 9 | — |
| Fluorine-containing agent (As Antistatic agent, coating aid, lubricant, adhesion inhibitor, or the like) | p.210 lower left column line 1 to p.222 lower left column line 5 | p.25 upper left column line 1 to p.27 lower right column line 9 | — |
| Binder (Hydrophilic colloid) | p.222 lower left column line 6 to p.225 upper left column last line | p.38 upper right column lines 8 to 18 | p.66 lines 23 to 28 |
| Thickening agent | p.225 upper right column line 1 to p.227 upper right column line 2 | — | — |
| Antistatic agent | p.227 upper right column line 3 to p.230 upper left column line 1 | — | — |
| Polymer latex | p.230 upper left column line 2 to p.239 last line | — | — |
| Matting agent | p.240 upper left column line 1 to p.240 upper right column last line | — | — |
| Photographic processing method (processing process, additive, etc.) | p.3 upper right column line 7 to p.10 upper right column line 5 | p.39 upper left column line 4 to p.42 upper left column last line | p.67 line 14 to p.69 line 28 |

Note: In the cited part of JP-A No. 215272/1987, amendment filed on March 16, 1987 is included. Further, among the above-mentioned couplers, it is preferred to use so called a short wavelength-type yellow coupler, described in JP-A Nos. 231451/1988, 123047/1988, 241547/1988, 173499/1989, 213648/1989, and 250944/1989, as a yellow coupler.

Preferably, the cyan, magenta, and yellow couplers are impregnated into loadable latex polymers (e.g., loadable latex polymers described in U.S. Pat. No. 4,203,716) in the presence or absence of a high-boiling organic solvent listed in the above table, or they are dissolved together with water-insoluble and organic solvent-soluble polymers and are emulsified and dispersed into hydrophilic colloid aqueous solution.

As water-insoluble and organic solvent-soluble polymers that can be preferably used, homopolymers or copolymers described in U.S. Pat. No. 4,857,449, the seventh column to the fifteenth column, and in International Publication No. WO 88/00723, pages 12 to 30, can be mentioned. More preferably, methacrylate-type polymers or acrylamide-type polymers, particularly acrylamide-type polymers, are used in view of color image stability and the like.

In the photographic material according to the present invention, color image preservability improving compounds as described in European Patent EP 0277589A2 are preferably used together with couplers, particularly, together with pyrazoloazole-type couplers and pyrrolotriazole-type couplers.

That is, the use of a compound described in the above-mentioned patent specifications that combines with the aromatic amine developing agent remaining after the color development processing to form a chemically inactive and substantially colorless compound and/or a compound described in the above-mentioned patent specifications that combines with the oxidized product of the aromatic amine color developing agent remaining after the color development processing to form a chemically inactive and substantially colorless compound simultaneously or singly is preferable. This is because, for example, the occurrence of stain or other side effects due to the formation of color formed dyes by the reaction of the color developing agent or its oxidized product remaining in the film during the storage after the processing with couplers can be prevented.

Further, as the cyan couplers, in addition to diphenylimidazole cyan couplers described in JP-A No. 33144/1990, 3-hydroxypyridine cyan couplers described in European Patent EP 0333185A2 (particularly, that formed by attaching a chlorine coupling-off group to the 4-equivalent coupler of Coupler (42) to make it to be 2-equivalent and Couplers (6) and (9) which are listed as specific examples are preferable), cyclic active methylene cyan couplers described in JP-A No. 32260/1989 (particularly Coupler Examples 3, 8, and 34 that are listed as specific examples are preferable), pyrrolopyrazole cyan couplers described in European Patent EP 0456226A1, pyrroloimidazole cyan couplers described in European Patent EP 0484909, and pyrrolotirazole cyan couplers described in European Patents EP 0488248 and EP 491197A1 are preferably used. Among them, pyrrolotriazole cyan couplers are particularly preferably used.

As the yellow couplers, in addition to the compounds listed in the above table, acylacetamide yellow couplers whose acyl group has a 3- to 5-membered cyclic structure described in European Patent EP 0447969A1, malondianilide yellow coupler having a cyclic structure described in European Patent EP 0482552A1, and acylacetamide yellow couplers having a dioxane structure described in U.S. Pat. No. 5,118,599 are preferably used. Among them, acylacetamide yellow couplers whose acyl group is a 1-alkylcyclopropane-1-carbonyl group and malondianilide yellow couplers wherein one of the anilide constitutes an indoline ring are preferably used. These couplers can be used alone or in combination.

As the magenta couplers used in the present invention, 5-pyrazolone magenta couplers and pyrazoloazole magenta couplers as described in the known literature shown in the above table are used, but in particular, in view, for example, of the hue, the stability of images, and the color forming properties, pyrazolotriazole couplers wherein a secondary or tertiary alkyl group is bonded directly to the 2-, 3-, or 6-position of the pyrazolotriazole ring as described in JP-A No. 65245/1986, pyrazoloazole couplers containing a sulfonamido group in the molecule as described in JP-A No. 65246/1986, pyrazoloazole couplers having an alkoxyphenylsulfonamido ballasting group as described in JP-A No. 147254/1986, and pyrazoloazole couplers having an alkoxy group or an aryloxy group in the 6-position as described in European Patent Nos. 226,849A and 294,785A are preferably used.

As the processing method of color photographic material of the present invention, besides methods described in the above-described table, processing materials and processing method described in JP-A No. 207250/1990, p.26 (right lower column line 1) to p.34 (right upper column line 9) and in JP-A No. 97355/1992, p.5 (left upper column line 17) to p.18 (right lower column line 20) are preferable.

According to the invention, a silver halide color photographic material suitable for continuous processing wherein the absolute value of sharpness, the dependency of sharpness on the frequency, and the non-coloring property of the white background are excellent can be obtained.

The present invention will now be described below specifically with reference to Examples, but the present invention is not restricted to them.

EXAMPLE 1

Various photographic constitutional layers were applied on the support 1 prepared as shown below, thereby preparing a multilayer color photographic printing paper (Sample 101) having layer composition shown below. Coating solutions were prepared as follows.

Preparation of the First Layer Coating Solution 153.0 Grams of yellow coupler (ExY), 15.0 g of image-dye stabilizer (Cpd-1), 7.5 g of image-dye stabilizer (Cpd-2), 11.6 g of image-dye stabilizer (Cpd-3) were dissolved in 150 ml of ethyl acetate, 25 g of solvent (Solv-1), and 25 g of solvent (Solv-2), and the resulting solution was dispersed and emulsified in 1,000 g of 10% aqueous gelatin solution containing 60 ml of 10% sodium dodecylbenzenesulfonate solution and 10 g of citric acid, thereby preparing emulsified dispersion A.

Separately silver chlorobromide emulsion B (comprising cubic grains made up of a mixture of a large size emulsion B1 having an average grain size of 0.83 μm and a small size emulsion B2 having an average grain size of 0.70 μm in a molar ratio of 6:4 in terms of silver, wherein the deviation coefficients of grain size distribution were 0.08 and 0.10, respectively, each of the emulsions had 0.3 mol % of silver bromide being localized on a part of grain surface, and the remaining part of grain was made up of silver chloride) was prepared.

The above-described emulsified dispersion A and this silver chlorobromide emulsion B were mixed together and dissolved to give the composition shown below, thereby preparing the first layer coating solution.

Coating solutions for the second to seventh layers were also prepared in the same manner as the coating solution of first layer. As a gelatin hardening gent for the respective layers 1-oxy-3,5-dichloro-s-triazine sodium salt was used.

Further, Cpd-13 and Cpd-14 were added in each layer in such amounts that the respective total amounts become 25.0 mg/m$^2$ and 50.0 mg/m$^2$.

Spectral sensitizing dyes shown below were used in respective silver chlorobromide emulsions of photosensitive emulsion layers.

Blue-sensitive emulsion layer:

Sensitizing dye A

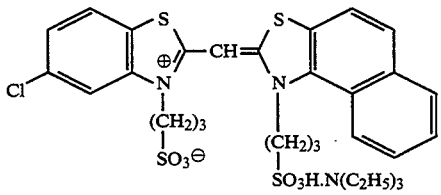

and Sensitizing dye B

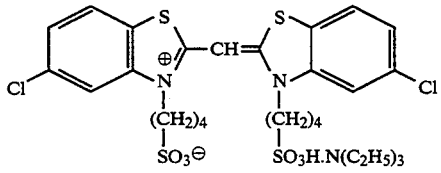

-continued (each $2.0 \times 10^{-4}$ mol per mol of silver halide for the large size emulsion and each $2.5 \times 10^{-4}$ mol per mol of silver halide for the small size emulsion)

Green-sensitive emulsion layer:

Sensitizing dye C

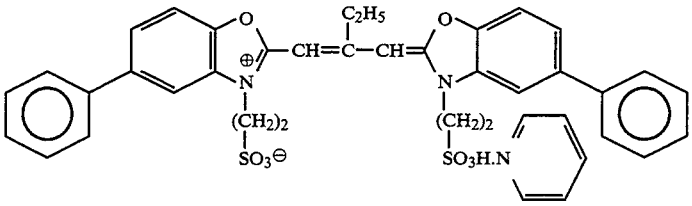

($4.0 \times 10^{-4}$ mol per mol of silver halide for the large size emulsion and $5.6 \times 10^{-4}$ mol per mol of silver halide for the small size emulsion)

and Sensitizing dye D

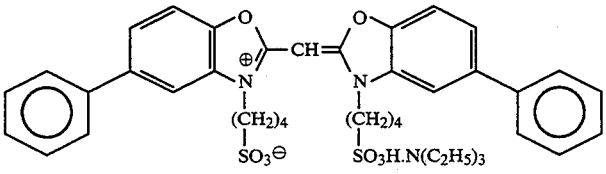

($7.0 \times 10^{-5}$ mol per mol of silver halide for the large size emulsion and $1.0 \times 10^{-4}$ mol per mol of silver halide for the small size emulsion)

Red-sensitive emulsion layer:

Sensitizing dye E

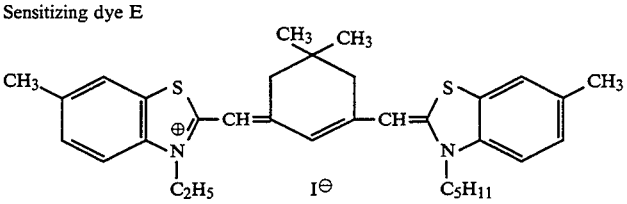

($0.9 \times 10^{-4}$ mol per mol of silver halide for the large size emulsion and $1.1 \times 10^{-4}$ mol per mol of silver halide for the small size emulsion)

Further, in the red-sensitive emulsion layer, the following compound was added in an amount of $2.6 \times 10^{-3}$ mol per mol of silver halide:

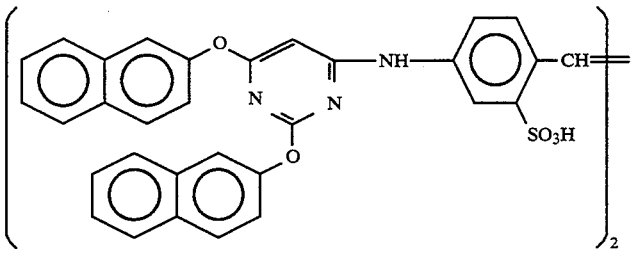

Further, 1-(5-methylureidophenyl)-5-mercaptotetrazole was added to the blue-sensitive emulsion layer, the green-sensitive emulsion layer, and the red-sensitive emulsion layer in amount of $3.4 \times 10^{-4}$ mol, $9.7 \times 10^{-4}$ mol, and $5.5 \times 10^{-4}$ mol, per mol of silver halide, respectively.

Further, 4-hydroxy-6-methyl-1,3,3a,7-tetrazaindene was added to the blue-sensitive emulsion layer and the green-sensitive emulsion layer in amount of $1 \times 10^{-4}$ mol and $2 \times 10^{-4}$ mol, per mol of silver halide, respectively.

(Composition of Layers)

The composition of each layer is shown below. The figures represent coating amount (g/m2). The coating amount of each silver halide emulsion is given in terms of silver.

| Support | |
|---|---|
| Support 1 | |
| First Layer (Blue-sensitive emulsion layer) | |
| Silver chlorobromide emulsion B described above | 0.27 |
| Gelatin | 1.44 |
| Yellow coupler (ExY) | 0.79 |
| Image-dye stabilizer (Cpd-1) | 0.08 |
| Image-dye stabilizer (Cpd-2) | 0.04 |
| Image dye stabilizer (Cpd-3) | 0.06 |
| Solvent (Solv-1) | 0.13 |
| Solvent (Solv-2) | 0.13 |
| Second Layer (Color-mix preventing layer) | |
| Gelatin | 1.44 |
| Color-mix inhibitor (Cpd-4) | 0.06 |
| Color-mix inhibitor (Cpd-10) | 0.02 |
| Solvent (Solv-2) | 0.25 |
| Solvent (Solv-3) | 0.25 |
| Third Layer (Green-sensitive emulsion layer) | |
| Silver chlorobromide emulsion (comprising cubic silver halide grains made up of a mixture of a large size emulsion G1 having an average grain size of 0.55 μm and a small size emulsion G2 having an average grain size of 0.39 μm in a molar ratio of 6:4 in terms of silver, wherein the deviation coefficients of grain size distribution were 0.10 and 0.08, respectively, each of the emulsions had 0.8 mol % of silver bromide being localized at a part of grain surface, and the remaining part of grains was made up of silver chloride) | 0.13 |
| Gelatin | 1.53 |
| Magenta coupler (ExM1) | 0.16 |
| Image-dye stabilizer (Cpd-6) | 0.15 |
| Image-dye stabilizer (Cpd-2) | 0.03 |
| Image-dye stabilizer (Cpd-7) | 0.01 |
| Image-dye stabilizer (Cpd-8) | 0.01 |
| Image-dye stabilizer (Cpd-9) | 0.08 |
| Solvent (Solv-3) | 0.50 |
| Solvent (Solv-4) | 0.15 |
| Solvent (Solv-5) | 0.15 |
| Fourth Layer (Color-mix preventing layer) | |
| Gelatin | 1.23 |
| Color-mix inhibitor (Cpd-4) | 0.04 |
| Ultraviolet absorber (UV-1) | 0.05 |
| Solvent (Solv-2) | 0.18 |
| Solvent (Solv-3) | 0.18 |
| Fifth Layer (Red-sensitive emulsion layer) | |
| Silver chlorobromide emulsion (comprising cubic silver halide grains made up of a mixture of a large size emulsion R1 having an average grain size of 0.58 μm and a small size emulsion R2 having an average grain size of 0.45 μm in a molar ratio of 7:3 in terms of silver, wherein the deviation coefficients of grain size distribution were 0.09 and 0.11, respectively, each of the emulsions had 0.6 mol % of silver bromide being localized at a part of grain surface, and the remaining part of grains was made up of silver chloride) | 0.20 |
| Gelatin | 0.91 |
| Cyan coupler (ExC) | 0.32 |
| Ultraviolet absorber (UV-2) | 0.05 |
| Image-dye stabilizer (Cpd-1) | 0.33 |
| Image-dye stabilizer (Cpd-6) | 0.15 |
| Image-dye stabilizer (Cpd-7) | 0.01 |
| Image-dye stabilizer (Cpd-9) | 0.01 |
| Solvent (Solv-1) | 0.01 |
| Solvent (Solv-3) | 0.60 |
| Sixth Layer (Ultraviolet absorbing layer) | |
| Gelatin | 0.77 |
| Ultraviolet absorber (UV-1) | 0.42 |
| Image-dye stabilizer (Cpd-11) | 0.15 |
| Image-dye stabilizer (Cpd-6) | 0.02 |
| Seventh Layer (Protective layer) | |
| Gelatin | 1.30 |
| Acryl-modified copolymer of polyvinyl alcohol (modification degree: 17%) | 0.15 |
| Liquid paraffin | 0.03 |
| Image-dye stabilizer (Cpd-12) | 0.01 |

Compounds used were as follows:

(ExY) Yellow coupler
Mixture ((a):(b) = 1:1 in molar ratio) of (a) R = 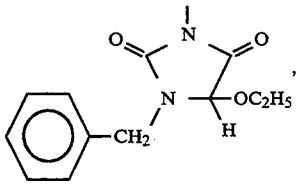

, X = Cl;

-continued
Support
and
(b) R = 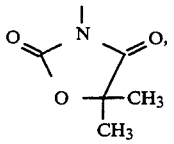 , X = $OCH_3$
of the following formula
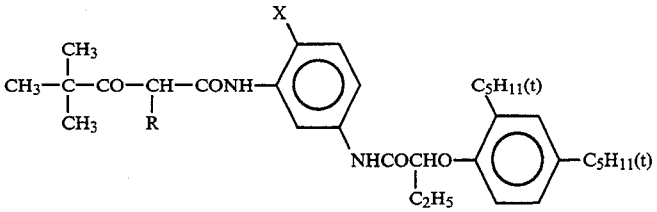
(ExM1) Magenta coupler
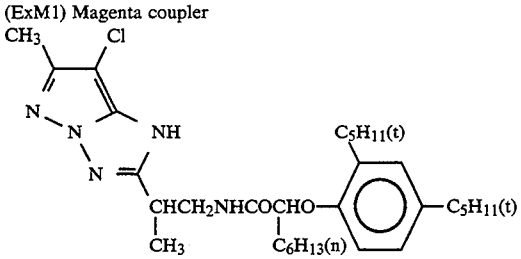
(ExM2) Magenta coupler
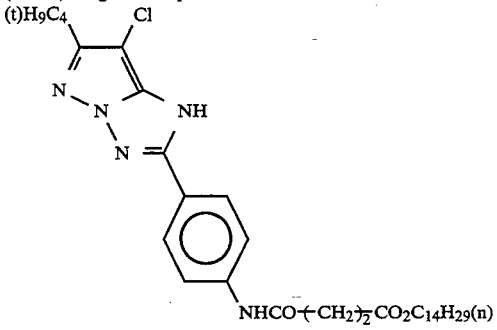
(ExC) Cyan coupler
Mixture (1:3 in weight ratio) of
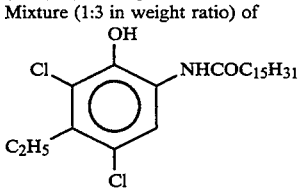
and
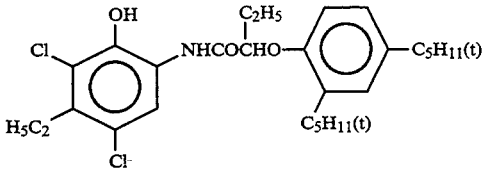
(Cpd-1) Image-dye stabilizer
$\left(CH_2-\underset{\displaystyle CONHC_4H_9(t)}{\underset{|}{CH}}\right)_n$
Av. molecular weight: 60,000

-continued
Support
(Cpd-2) Image-dye stabilizer
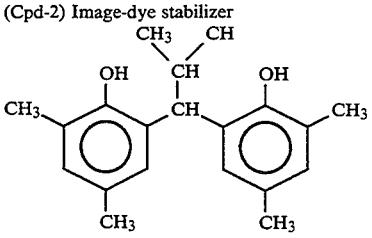
(Cpd-3) Image-dye stabilizer
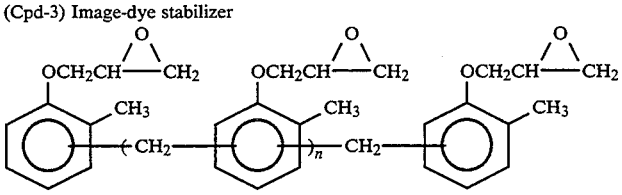
n = 7–8 (in average)
(Cpd-4) Color-mix inhibitor
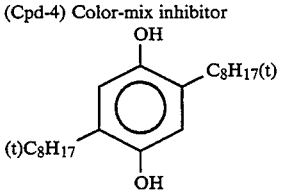
(Cpd-6) Image-dye stabilizer
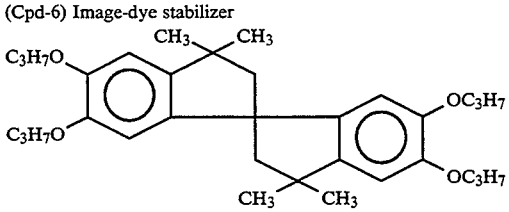
(Cpd-7) Image-dye stabilizer
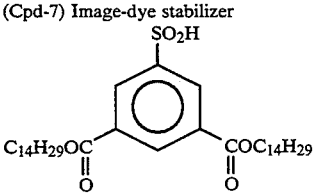
(Cpd-8) Image-dye stabilizer
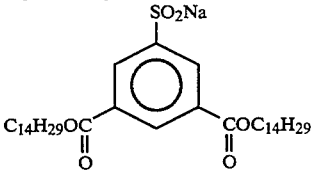
(Cpd-9) Image-dye stabilizer
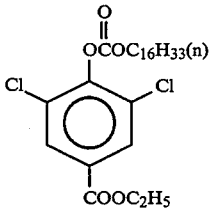
(Cpd-10) Color-mix inhibitor
Mixture (2:3 in weight ratio) of
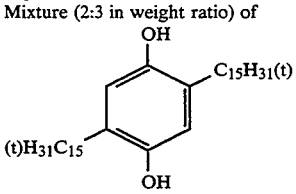
and
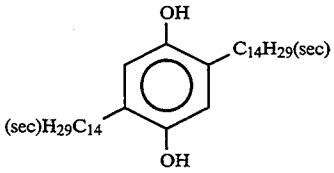
(Cpd-11) Image-dye stabilizer
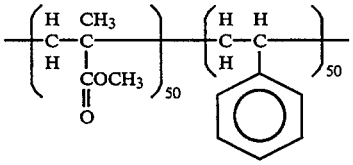
av. molecular weight: ca. 60,000

-continued
Support
(Cpd-12) Image-dye stabilizer
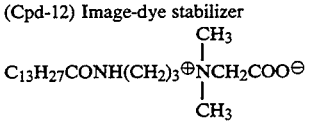
(Cpd-13) Antiseptic
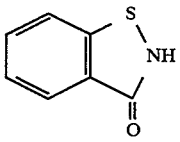
(Cpd-14) Antiseptic
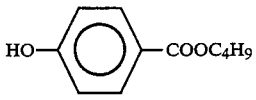
(UV-1) Ultraviolet ray absorber
Mixture of (1), (2), (3), and (4) (1:5:10:5 in weight ratio)
(1)
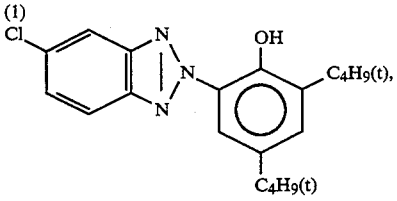
(2)
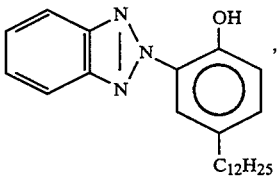
(3)
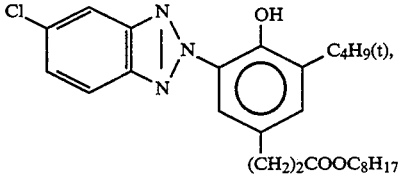
and
(4)
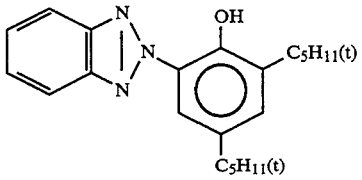
(UV-2) Ultraviolet ray absorber
Mixture of (5), (6), and (7) (1:2:2 in weight ratio)
(5)
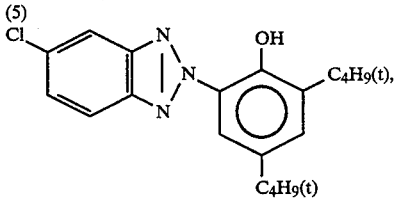
(6)
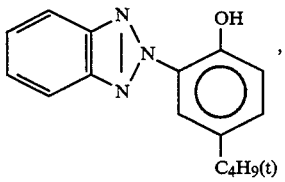
and
(7)
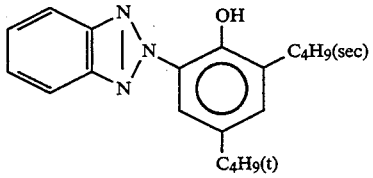
(Solv-1) Solvent
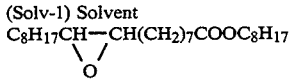
(Solv-2) Solvent
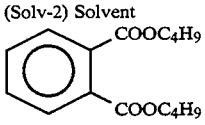
(Solv-3) Solvent
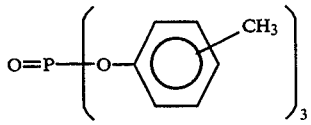
(Solv-4) Solvent
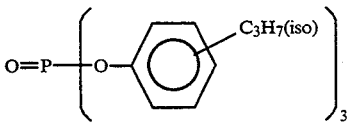

-continued

| Support |
|---|
| (Solv-5) Solvent<br>$O{=}P{-}(OCH_2CH(C_2H_5)C_4H_9(n))_3$ |
| (Solv-8) Solvent<br>Mixture (1:1 in weight ratio) of<br>$O{=}P{-}(OC_6H_{12}(n))_3$ and $(CH_2)_8(COOC_4H_9)_2$ |

Sample 101 was exposed to a three-color separated light for sensitometry using a sensitometer (FWH-type, manufactured by Fuji Photo Film Co., Ltd.; color temperature of the light source: 3200K). The exposure to light was carried out under conditions of an exposure time of 0.1 sec and an exposure amount of 250 CMS.

The exposed Sample was processed using a paper processor in the following processing steps with solutions having the following compositions.

| Processing step | Temperature | Time | Replenisher* | Tank Volume |
|---|---|---|---|---|
| Color developing | 35° C. | 45 sec | 161 ml | 17 liter |
| Bleach-fixing | 30–35° C. | 45 sec | 215 ml | 17 liter |
| Rinse | 30° C. | 90 sec | 350 ml | 10 liter |
| Drying | 70–80° C. | 60 sec | | |

Note: *Replenisher amount per $m^2$ of photographic material.

The composition of each processing solution was as follows, respectively:

| Color-developer | Tank Solution | Replenisher |
|---|---|---|
| Water | 800 ml | 800 ml |
| Ethylenediamine-N,N,N',N'-tetramethylene phosphonic acid | 1.5 g | 2.0 g |
| Potassium bromide | 0.015 g | — |
| Triethanolamine | 8.0 g | 12.0 g |
| Potassium chloride | 1.4 g | - |
| Potassium carbonate | 25.0 g | 25.0 g |
| N-Ethyl-N-(β-methanesulfoneamidoethyl)-3-methyl-4-aminoaniline sulfonate | 5.0 g | 7.0 g |
| N,N-bis(carboxymethyl)hydrazine | 4.0 g | 5.0 g |
| Sodium N,N-bis(sulfoethyl)-hydroxylamine | 4.0 g | 5.0 g |
| Fluorescent whitening agent (WHITEX 4B, made by Sumitomo Chem. Co.) | 1.0 g | 2.0 g |
| Water to make | 1000 ml | 1000 ml |
| pH (25° C.) | 10.05 | 10.45 |
| Bleach-fixing solution (Both tank solution and replenisher) | | |
| Water | 400 ml | |
| Ammonium thiosulfate (700 g/l) | 100 ml | |
| Sodium sulfite | 17 g | |
| Iron (III) ammonium ethylenediaminetetraacetate | 55 g | |
| Disodium ethylenediaminetetraacetate | 5 g | |
| Ammonium bromide | 40 g | |
| Water to make | 1000 ml | |
| pH (25° C.) | 6.0 | |
| Rinse solution (Both tank solution and replenisher) | | |
| Ion-exchanged water (calcium and magnesium each are 3 ppm or below) | | |

Samples 102 to 120 were prepared in the same manner as Sample 101, except that the support and the added amounts of gelatin in the 2nd layer, the 4th layer, the 6th layer, and the 7th layer and the additive and its amount in the 2nd layer and the 7th layer were changed as shown in Table 2.

Herein, a compound represented by formula (Sa) was dispersed using a vibration ball mill by the following method, to obtain a dispersion having an average grain size of 0.35 μm:

Water (21.7 ml), 3 ml of 5 wt % aqueous solution of sodium p-octylphenoxyethoxyethane sulfonate, and 0.5 g of 5 wt % aqueous solution of p-octylphenoxy polyoxyethyleneether (polymerization degree: 10) were introduced into a 700 ml-pot-mill, and 0.5 g of a dye represented by formula (Sa) of this invention and beads of zirconium oxide (bead diameter: 1 mm, volume: 500 ml) were added thereto, followed by dispersing the contents for 2 hours. The vibration ball mill was BO-type, made by Chuo Kakoki Co.

The contents were taken out and added into 8 g of 12.5 wt % of aqueous gelatin solution, and then beads were filtered off, to obtain a dispersion of a dye and gelatin.

Preparation of base paper and preparation of support were carried out as shown below.

(Preparation of Base Paper)

A wood pulp mixture [bleached sulfate pulp from hardwoods and bleached sulfite pulp from softwoods (LBKP/NBSP)=2/1] was subjected to beating, to obtain a pulp slurry having a Canadian Standard Freeness of 250 ml. After the pulp slurry was diluted with water, based on the pulp weight, 1.0% of an anionic polyacrylamide (Polystrone 195, molecular weight: about 110,000, manufactured by Arakawa Kagaku KK), 1.0% of aluminum sulfate, and 0.15% of a polyamide polyamine epichlorohydrin (available under the trade name Kaimen 557, manufactured by DIC Hercules Co.), each of which amounts was based on pulp were added with stirring. Then, based on the pulp weight, each 0.4% of epoxidized behenic acid amide and analkylketene dimer (whose alkyl group is $C_{20}H_{41}$) were added; then sodium hydroxide, a cationic polyacrylamide, and 0.1 wt % of an antifoamer were added, to bring the pH to 7. The thus prepared pulp slurry was made into a sheet of paper having a basis weight of 180 g/$m^2$.

The water content of the thus prepared base paper was brought by an oven to about 2 wt %, and then the base paper was size-pressed with an aqueous solution having the following formulation as a surface sizing solution, so that the coating amount of the solution on the surface of the base paper (on the side where photographic emulsions would be applied) might be 20 g/$m^2$.

Poly(vinyl alcohol): 4.0 wt %
Calcium chloride: 4.0 wt %
Fluorescent brightening agent: 0.5 wt %
Antifoamer: 0.005 wt %

The thickness of the paper after size-press treated was adjusted by a machine calender to 180 μm, to obtain a base paper.

(Preparation of a Support)

A mixed composition of a polyester (limiting viscosity: 6.5; molecular weight: about 40,000), synthesized by polycondensation of a dicarboxylic acid composition shown in Table 2 with ethylene glycol, or polyethylene and titanium oxide (KA-10, manufactured by Titan Kogyo), was melted and mixed at 300° C. by a twin-screw mixing extruder and was melt-extruded from a T-die onto the surface of the 180 μm thickness base paper, so that a lamination layer having a thickness of 30 μm might be formed. A calcium carbonate-containing polyester resin composition was melt-extruded at 300° C. onto the other surface of the base paper, so that a lamination layer having a thickness of 30 μm might be formed. The resin surface to be emulsion-coated of this laminated reflective support, where emulsions would be applied was subjected to a corona discharge treatment and was coated with a coating solution having the following composition in an amount of 5 ml/m$^2$, and it was dried at 80° C. for 2 min, to obtain Photographic Supports 1 to 9.

[Formulation of the Undercoat]

| | | |
|---|---|---|
| Compound ExU1 | 0.2 | g |
| Compound ExU2 | 0.001 | g |
| $H_2O$ | 35 | ml |
| Methanol | 65 | ml |
| Gelatin | 2 | g |
| pH | 9.5 | |

ExU1

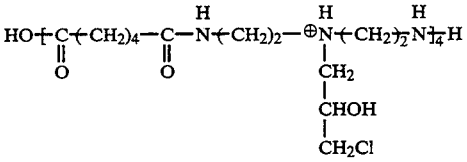

ExU2

$C_{12}H_{25}O(CH_2CH_2O)_{10}H$ developed by the same processing steps used for Sample 101.

All of the samples thus obtained were evaluated as follows:

(Degree of coloring of the white background)

The cyan density (Dmin) of the uncolor-formed part of the thus processed respective samples was measured by X-Rite 310 (manufactured by The X-Rite Co.), and the degree of coloring of the white background was expressed in terms of a difference value (ΔDmin) (Fr) between the cyan density of Sample and that of Sample 104.

The yellow density of the uncolor-formed part of the above processed respective samples was measured by X-Rite 310 before and after they were stored for 8 days in the dark at 80° C.-70% RH, to obtain the difference (ΔDmin) between the yellow densities before and after storage, which was used as a scale of coloring after the storage under heat and humidity.

(Sharpness)

Herein, the value called CTF (Contrast Transfer Function) was used. CTF indicates the attenuation of the amplitude for the spacial frequency as square waveform and herein the values of CTF at the spacial frequencies of 2.5 and 15 per mm are shown. The greater the value is, the higher the sharpness is. The samples for the measurement of CTF were exposed to light using a test chart for resolving power though a red filter and were processed in the above manner.

(Storage stability)

After the unprocessed samples obtained in the above manner were stored for 6 months at 35° C., they were exposed to light and were processed in the same way as described above, except that a wedge that gives gradation exposure for sensitometry through a blue filter was used. The sensitivity difference ($\Delta S_{1.0}$) between the sensitivity $S_{rt}$ (the value of the logarithm of the reciprocal of the amount of light required to obtain a density of 1.0 for the yellow color-formed layer was designated as the sensitivity) of the sample and the sensitivity $S_{Fr}$ of the same sample after the storage in a refrigerator was calculated and was used as a scale of the storage stability of the photographic material.

TABLE 1

| Support Species | Resin (Composition of dicarboxylic acid of polyester) (in molar ratio) | $TiO_2$ (wt %) | Remarks |
|---|---|---|---|
| 1 | Polyethylene | 15 | Comparison |
| 2 | Polyethylene | 25 | Comparison |
| 3 | Polyester (Terephthalic acid: 100) | 15 | This Invention |
| 4 | Polyester (Terephthalic acid: 100) | 25 | This Invention |
| 5 | Polyester (Terephthalic acid/Isophthalic acid: 90/10) | 15 | This Invention |
| 6 | Polyester (Terephthalic acid/Isophthalic acid: 90/10) | 25 | This Invention |
| 7 | Polyester (Terephthalic acid/Isophthalic acid: 50/50) | 25 | This Invention |
| 8 | Polyester (Terephthalic acid/naphthalenedicarboxylic acid: 90/10) | 25 | This Invention |
| 9 | Polyester (Terephthalic acid/naphthalenedicarboxylic acid: 50/50) | 25 | This Invention |

Note; The molecular weights of polyesters were about 40,000.

The thus prepared samples were exposed to light in the same way as for Sample 101 and were color- All of the above results are shown in Table 2.

TABLE 2

| Sample No. | Support Species | Coating amount (g/m$^2$) of gelatin: 2nd layer | 4th layer | 6th layer | 7th layer | Total | Compound represented by formula (Sa): Species | Coating amount* | Added layer | Coloring of white background: ΔDmin (Fr) | ΔDmin (H&H**) | Sharpness: 2.5 C/mm | 15 C/mm |
|---|---|---|---|---|---|---|---|---|---|---|---|---|---|
| 101 | 1 | 1.50 | 1.29 | 0.97 | 1.36 | 9.00 | — | — | — | 0.00 | 0.10 | 0.94 | 0.16 |
| 102 | 1 | 1.35 | 1.14 | 0.87 | 1.26 | 8.50 | — | — | — | 0.00 | 0.03 | 0.94 | 0.17 |
| 103 | 1 | 1.13 | 0.95 | 0.59 | 1.15 | 7.70 | — | — | — | 0.00 | 0.02 | 0.95 | 0.18 |
| 104 | 1 | 0.99 | 0.70 | 0.55 | 1.13 | 7.25 | — | — | — | 0.00 | 0.02 | 0.96 | 0.18 |
| 105 | 2 | 0.99 | 0.70 | 0.55 | 1.13 | 7.25 | — | — | — | 0.00 | 0.02 | 0.96 | 0.20 |

TABLE 2-continued

| | | | | | | | | | | | | | |
|---|---|---|---|---|---|---|---|---|---|---|---|---|---|
| 106 | 3 | 0.99 | 0.70 | 0.55 | 1.13 | 7.25 | — | — | — | 0.00 | 0.02 | 0.96 | 0.23 |
| 107 | 4 | 0.99 | 0.70 | 0.55 | 1.13 | 7.25 | — | — | — | 0.00 | 0.03 | 0.97 | 0.25 |
| 108 | 2 | 0.99 | 0.70 | 0.55 | 1.13 | 7.25 | Sa-1 | 0.05 | 4th | 0.00 | 0.04 | 1.00 | 0.44 |
| 109 | 2 | 0.99 | 0.70 | 0.55 | 1.13 | 7.25 | Sa-1 | 0.10 | 4th | 0.01 | 0.06 | 1.01 | 0.47 |
| 110 | 3 | 0.99 | 0.70 | 0.55 | 1.13 | 7.25 | Sa-1 | 0.04 | 4th | 0.00 | 0.03 | 1.00 | 0.48 |
| 111 | 4 | 0.99 | 0.70 | 0.55 | 1.13 | 7.25 | Sa-1 | 0.04 | 4th | 0.00 | 0.03 | 1.01 | 0.49 |
| 112 | 4 | 0.99 | 0.70 | 0.55 | 1.13 | 7.25 | Sb-7 | 0.05 | 2nd | 0.00 | 0.04 | 1.01 | 0.49 |
| 113 | 4 | 0.99 | 0.70 | 0.55 | 1.13 | 7.25 | Sc-11 | 0.04 | 4th | 0.00 | 0.03 | 1.01 | 0.50 |
| 114 | 4 | 1.35 | 1.14 | 0.87 | 1.26 | 8.50 | Sc-11 | 0.04 | 4th | 0.00 | 0.04 | 1.00 | 0.49 |
| 115 | 4 | 1.50 | 1.29 | 0.97 | 1.36 | 9.00 | Sc-11 | 0.04 | 4th | 0.01 | 0.14 | 1.00 | 0.48 |
| 116 | 5 | 0.99 | 0.70 | 0.55 | 1.13 | 7.25 | Sa-1 | 0.04 | 4th | 0.00 | 0.03 | 1.00 | 0.49 |
| 117 | 6 | 0.99 | 0.70 | 0.55 | 1.13 | 7.25 | Sa-1 | 0.04 | 2nd | 0.00 | 0.04 | 0.95 | 0.69 |
| 118 | 7 | 0.99 | 0.70 | 0.55 | 1.13 | 7.25 | Sa-1 | 0.04 | 4th | 0.00 | 0.03 | 0.95 | 0.69 |
| 119 | 8 | 0.99 | 0.70 | 0.55 | 1.13 | 7.25 | Sc-11 | 0.04 | 2nd | 0.00 | 0.03 | 0.96 | 0.70 |
| 120 | 9 | 0.99 | 0.70 | 0.55 | 1.13 | 7.25 | Sb-7 | 0.04 | 4th | 0.00 | 0.03 | 0.96 | 0.69 |

| Sample No. | Support Species | Storage Stability $\Delta S_{1.0}$ | Remarks |
|---|---|---|---|
| 101 | 1 | 0.02 | Comparative Example |
| 102 | 1 | 0.02 | Comparative Example |
| 103 | 1 | 0.02 | Comparative Example |
| 104 | 1 | 0.02 | Comparative Example |
| 105 | 2 | 0.02 | Comparative Example |
| 106 | 3 | 0.04 | Comparative Example |
| 107 | 4 | 0.04 | Comparative Example |
| 108 | 2 | 0.02 | Comparative Example |
| 109 | 2 | 0.01 | Comparative Example |
| 110 | 3 | 0.00 | This Invention |
| 111 | 4 | 0.00 | This Invention |
| 112 | 4 | 0.00 | This Invention |
| 113 | 4 | 0.00 | This Invention |
| 114 | 4 | 0.00 | This Invention |
| 115 | 4 | 0.00 | Comparative Example |
| 116 | 5 | 0.00 | This Invention |
| 117 | 6 | 0.00 | This Invention |
| 118 | 7 | 0.00 | This Invention |
| 119 | 8 | 0.00 | This Invention |
| 120 | 9 | 0.00 | This Invention |

Note;
*Coating amount : g/m$^2$
**H&H : Storage in darkness for 8 days at 80° C. and 70% RH As is apparent from Table 2, in contrast to Comparative Sample 101, in Comparative Samples 102 to 104, the sharpness was made a little better simply by decreasing the total amount of gelatin, but it was still not satisfactory and the photographic properties were not satisfactory.

Next, in contrast to Comparative Sample 104, in Comparative Sample 105, wherein the amount of titanium oxide was increased, the sharpness was made better but the degree of the improvement was small.

On the other hand, in contrast to Comparative Samples 104 and 105, in Comparative Samples 106 and 107, wherein the support of the present invention was used and the amount of the titanium oxide was the same as that of Comparative Samples 104 and 105, the effect of improvement in sharpness was good and preferable, but the non-coloring property of the white background after the storage in the dark was deteriorated. Further, the storage stability was not at a satisfactory level.

In contrast to Comparative Sample 105, in Comparative Samples 108 and 109, wherein a solid dispersion of the compound represented by formula (Sa) was added, the sharpness was made better, but it was still not satisfactory, and the non-coloring property of the white background was deteriorated.

In contrast, with respect to Samples 110 to 114 and 116 to 120 of the present invention, the sharpness both in the high-frequency region and in the low-frequency region was made remarkably better, and a photographic material excellent in sharpness through the frequency region and excellent in non-coloring property of the white background was obtained. Further, an unexpected effect was obtained in that the storage stability of these Samples of the present invention was also made best.

Further, in contrast to Sample 113 of the present invention, in Sample 114 and Comparative Sample 115, wherein the total applied amount of gelatin was increased to 8.50 and 9.00 g/m$^2$, respectively, Comparative Sample 115, wherein the total applied amount of gelatin was 9.00 g/m$^2$, was poor in non-coloring property of the white background after the storage under heat and humidity.

The coloring dependency of the white background on the applied amount of gelatin after the storage under heat and humidity was conspicuous when the support of the present invention was used, but the absolute value of the coloring in the case wherein the support according to the present invention was used was smaller than that in the case wherein a support for comparison was used.

That is, from the results shown in Table 2, it can be understood that the Samples of the present invention were excellent in all of the respects of sharpness, non-coloring property of the uncolor-formed white background, and storage stability.

On the other hand, Samples 101 to 120 were exposed to light in the same way as above, and the thus exposed Samples 101 to 120 were continuously processed using the same processing steps and processing composition solutions as those used above, until the replenishing had reached twice the amount of the tank volume of the color developer, so that development processing solutions that were in their equilibrium state were prepared.

Using these paper processing solutions, the same test carried out above was effected, and it was confirmed that the effect of the present invention was attained.

EXAMPLE 2

The procedure for the preparation of Samples 113 and 117 in Example 1 was repeated, except that compounds represented by formulas (I), (II), and (III) were contained as shown in Table 3, thereby preparing Samples 201 to 206, and the same test as in Example 1 was carried out.

Here, the compounds represented by formulas (I), (II), and (III) were made into aqueous solutions containing 5 wt % of the said compounds, respectively, and the solutions were added so that the applied amounts might be as shown in Table 3.

TABLE 3

| Sample No. | Compound represented by formula (Sa) Species | Compound represented by formula (Sa) Added amount ($g/m^2$) | Compound represented by formula (I) to (III) Species | Compound represented by formula (I) to (III) Added amount ($g/m^2$) | Coloring of white background ΔDmin (Fr) | Coloring of white background ΔDmin (H&H**) | Sharpness 2.5 C/mm | Sharpness 15 C/mm | Storage Stability $\Delta S_{1.0}$ | Remarks |
|---|---|---|---|---|---|---|---|---|---|---|
| 113 | Sc-11 | 0.04 | — | — | 0.00 | 0.04 | 1.01 | 0.49 | 0.00 | This Invention |
| 201 | Sc-11 | 0.03 | a-12/a-27 = 1/1 | 0.04 | 0.00 | 0.04 | 1.01 | 0.52 | 0.00 | This Invention |
| 202 | Sc-11 | 0.04 | a-12/a-27 = 1/1 | 0.04 | 0.00 | 0.04 | 1.01 | 0.53 | 0.00 | This Invention |
| 203 | Sc-11 | 0.04 | a-12/a-27 = 1/1 | 0.05 | 0.00 | 0.05 | 1.02 | 0.55 | 0.00 | This Invention |
| 117 | Sa-1 | 0.04 | — | — | 0.00 | 0.04 | 1.00 | 0.49 | 0.00 | This Invention |
| 204 | Sa-1 | 0.04 | a-18/III-8 = 1/1 | 0.06 | 0.00 | 0.05 | 1.01 | 0.52 | 0.00 | This Invention |
| 205 | Sa-1 | 0.04 | I-27 | 0.06 | 0.00 | 0.04 | 1.01 | 0.53 | 0.00 | This Invention |
| 206 | Sa-1 | 0.04 | a-42/II-1 = 2/1 | 0.05 | 0.00 | 0.04 | 1.01 | 0.52 | 0.00 | This Invention |
| Reference | — | — | a-12/a-27 = 1/1 | 0.15 | 0.00 | 0.07 | 0.97 | 0.39 | 0.00 | Comparison |

Note; **H&H : Storage in darkness for 8 days at 80° C. and 70% RH

As is apparent from the results in Table 3, in contrast to Samples 113 and 117, Samples 201 to 206, wherein compound represented by formulas (I), (II), or (III) was additionally used, were made better in sharpness in the high-frequency region, and the dependency of sharpness on the frequency was improved. In this case, the non-coloring property of the white background and the storage stability were not deteriorated.

On the other hand, Samples 201 to 206 were exposed to light in the same way as above, and the thus exposed Samples 201 to 206 were continuously processed using the same processing steps and processing composition solutions as those used above, until the replenishing had reached twice the amount of the tank volume of the color developer, so that development processing solutions that were in their equilibrium state were prepared.

Using these paper processing solutions, the same test carried out above was effected, and it was confirmed that the effect of the present invention was obtained.

EXAMPLE 3

The procedure for the preparation of Samples 101 to 120 in Example 1 was repeated, except that a color-mix inhibitor (Cpd-10) was added into the second layer and the fourth layer, in an amount of 0.04 $g/m^2$ in each layer, and the third layer was constituted as shown below, thereby preparing Samples, and the same test as in Example 1 was carried out, by which the effect of the present invention was confirmed, as in Example 1.

| Third Layer (Green-sensitive emulsion layer) | |
|---|---|
| Silver chlorobromide emulsion (comprising cubic silver halide grains made up of a mixture of a large size emulsion G1 having an average grain size of 0.55 μm and a small size emulsion G2 having an average grain size of 0.39 μm in a molar ratio of 6:4 in terms of silver, wherein the deviation coefficients of grain size distribution were 0.10 and 0.08, respectively, each of the emulsions had 0.8 mol % of silver bromide being localized at a part of grain surface, and the remaining part of grains was made up of silver chloride) | 0.13 |
| Gelatin | 1.53 |
| Magenta coupler (ExM2) | 0.25 |
| Image-dye stabilizer (Cpd-6) | 0.05 |
| Image-dye stabilizer (Cpd-2) | 0.03 |
| Image-dye stabilizer (Cpd-7) | 0.01 |
| Image-dye stabilizer (Cpd-8) | 0.01 |
| Image-dye stabilizer (Cpd-9) | 0.05 |
| Solvent (Solv-8) | 0.50 |

EXAMPLE 4

With respect to Samples 101 to 120 and 201 to 206 prepared in Examples 1 and 2, respectively, the same evaluation as in Example 1 was performed, except that the below-described exposure to light was carried out. The obtained results were similar to those in Examples 1 and 2, respectively.

(Exposure to light)

The light sources used were a laser beam of wavelength 473 nm, which was taken out by wavelength conversion using an SHG crystal of $KNbO_3$ from a YAG solid laser (oscillation wavelength: 946 nm), which used as an excitation light source a GaAlAs semiconductor laser (oscillation wavelength: 808.5 nm), a laser beam of wavelength 532 nm, which was taken out by wavelength conversion using an SHG crystal of KTP from a $YVO_4$ solid laser (oscillation wavelength: 1064 nm), which used as an excitation light source a GaAlAs semiconductor laser (oscillation wavelength: 808.7 nm), and a laser beam of AlGaInP (oscillation wavelength: about 670 nm; Type No. TOLD9211, manufactured by Toshiba Co.). The apparatus was constituted such that each laser beam was allowed, by a rotating polyhedron, to scan color paper that was moved vertically to the scanning direction, to carry out successive scanning exposure. Using this apparatus, the amount of light was varied and the relationship D/log E between the density (D) of the photographic material and the amount of light (E) was obtained. The amounts of the laser beams of three wavelengths were modulated using an external modulator, to control the amounts of the exposure to lights. This scanning exposure was carried out with 400 dpi, and the average exposure time per picture element was $5\times10^{-8}$ sec. In order to suppress the change of the amount of light of the semiconductor laser that would be caused by temperature, the temperature thereof was kept constant by using a Peltier element.

Having described our invention as related to the present embodiments, it is our intention that the invention not be limited by any of the details of the description, unless otherwise specified, but rather be construed broadly within its spirit and scope as set out in the accompanying claims.

What we claim is:

1. A silver halide color photographic material having, on a reflective support, photographic constitutional layers comprising at least one photosensitive silver halide emulsion layer and at least one non-photosensitive hydrophilic colloid layer, which comprises a reflective support obtained by covering at least a surface with a composition of a resin to form a resin-coated surface, wherein the resin-coated surface is emulsion-coated, wherein said resin, whose major component is polyester, comprises a white pigment mixed and dispersed therein, wherein the major component of the resin is a polyester synthesized by polycondensation of a dicarboxylic acid and a diol; and said at least one non-photosensitive hydrophilic colloid layer contains a dispersion of solid fine particles of at least one compound represented by the following formula (Sa); with the total amount of gelatin contained in the photographic constitutional layers being 8.5 g/m$^2$ or less; and with the silver chloride content of the silver halide emulsion contained in the at least one photosensitive silver halide emulsion layer being 90 mol % or more:

$$D-(X)_y \qquad \text{formula (Sa)}$$

wherein D represents a compound having a chromophore; X represents a dissociable proton which is bonded to D directly or through a divalent linking group or a group having a dissociable proton, and y is an integer of 1 to 7;

wherein the compound represented by formula (Sa) is one represented by the following formula (Sb), (Sc), (Sd), or (Se):

$$A_1{=}L_1{\leftrightharpoons}L_2{=}L_3{\rightharpoonup}_m Q \qquad \text{formula (Sb)}$$

$$A_1{=}L_1{\leftrightharpoons}L_2{=}L_3{\rightharpoonup}_n A_2 \qquad \text{formula (Sc)}$$

$$A_1{\leftrightharpoons}L_1{-}L_2{\rightharpoonup}_p B_1 \qquad \text{formula (Sd)}$$

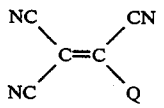

formula (Se)

wherein $A_1$ and $A_2$ each represent an acid nucleus; $B_1$ represents a basic nucleus; Q represents an aryl group or a heterocyclic ring moiety, $L_1$, $L_2$ and $L_3$ each represent a methine group; m is 0, 1 or 2; and n and p are each 0, 1, 2, or 3; provided that the compound represented by one of formulae (Sb) to (Se) has at least one group selected from the group consisting of a carboxylic acid group, a sulfonamido group, an arylsulfamoyl group, a sulfonylcarbamoyl group, a carbonylsulfamoyl group, and an enol group, and the compound does not have other water soluble groups;

wherein at least one photosensitive silver halide emulsion layer or hydrophilic colloid layer further contains at least one compound represented by the following formula (I), (II), or (III):

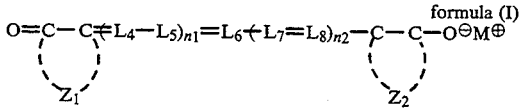

formula (I)

wherein $Z_1$ and $Z_2$, which may be the same or different, each represent a group of nonmetal atoms required to form a heterocyclic ring moiety; $L_4$, $L_5$, $L_6$, $L_7$, and $L_8$ each represent a methine group; $n_1$ and $n_2$ each are 0 or 1; and $M^{\oplus}$ represents a hydrogen or other monovalent cation, $$Ar_1-N=N-Ar_2 \qquad \text{formula (II)}$$

wherein $Ar_1$ and $Ar_2$, which may be the same or different, each represent an aryl group or a heterocyclic group,

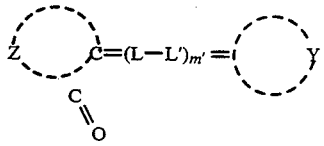

wherein L and L' each represent a substituted or unsubstituted methine group or a nitrogen atom, Z and Y each represent a group of nonmetal atoms required to form a heterocyclic ring moiety, and m' is 0, 1, 2 or 3.

2. The silver halide color photographic material as claimed in claim 1, wherein the dicarboxylic acid is selected from the group consisting of terephthalic acid, isophthalic acid, and naphthalenedicarboxylic acid.

3. The silver halide color photographic material as claimed in claim 1, wherein the diol is selected from the group consisting of ethylene glycol, butylene glycol, neopentyl glycol, triethylene glycol, butanediol, hexylene glycol, 2,2-bis(4-(2-hydroxyethyloxy)phenyl)propane, and 1,4-dihydroxymethylcyclohexane.

4. The silver halide color photographic material as claimed in claim 1, wherein the white pigment is selected from the group consisting of titanium oxide, barium sulfate, lithopone, aluminum oxide, calcium carbonate, silicon oxide, antimony trioxide, titanium phosphate, zinc oxide, white lead, zirconium oxide, and finely divided powders of a polystyrene or a styrene/divinylbenzene copolymer.

5. The silver halide color photographic material as claimed in claim 1, wherein the resin of the reflective support is one whose major component is polyethylene terephthalate.

6. The silver halide color photographic material as claimed in claim 1, wherein the polyester is one synthesized by polycondensation of mixed dicarboxylic acids of terephthalic acid and isophthalic acid and a diol, one surface of the support, which is said resin-coated surface, is covered with a resin whose major component is said polyester, and the other surface of the support is covered with a polyester resin or a resin composition containing a powder being mixed and dispersed into a polyester resin.

7. The silver halide color photographic material as claimed in claim 1, wherein the polyester is one synthesized by polycondensation of mixed dicarboxylic acids of terephthalic acid and naphthalenedicarboxylic acid and a diol, one surface of the support, which is said resin-coated surface, is covered with a resin whose major component is said polyester, and the other surface of the support is covered with a polyester resin or a resin composition containing a powder being mixed and dispersed into a polyester resin.

8. The silver halide color photographic material as claimed in claim 1, wherein the diol is ethylene glycol.

9. The silver halide color photographic material as claimed in claim 1, wherein the white pigment is titanium oxide and the weight ratio of the titanium oxide to the resin, whose major component is a polyester, is from 5/95 to 50/50.

10. The silver halide color photographic material as claimed in claim 1, wherein the average particle diameter of the solid fine particles in the hydrophilic colloid layer is 10 μm or less.

11. The silver halide color photographic material as claimed in claim 1, wherein the amount of compound represented by formula (Sb), (Sc), (Sd), or (Se) used is 10 to 800 mg/m$^2$ of the photographic material.

12. The silver halide color photographic material as claimed in claim 1, wherein the compound represented by formula (I) is represented by the following formula (I-a):

formula (I-a)

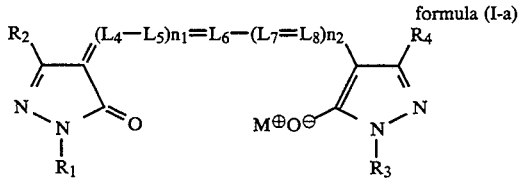

wherein $R_1$ and $R_3$ each represent an aliphatic group, an aromatic group, or a heterocyclic group, $R_2$ and $R_4$ each represent an aliphatic group, an aromatic group, —$OR_5$, —$COOR_5$, —$NR_5R_6$, —$CONR_5R_6$, —$NR_5CONR_5R_6$, —$SO_2R_7$, —$COR_7$, —$NR_6COR_7$, —$NR_6SO_2R_7$, or a cyano group, wherein $R_5$ and $R_6$ each represent a hydrogen atom, an aliphatic group, or an aromatic group, $R_7$ represents an aliphatic group or an aromatic group, and $R_5$ and $R_6$ together and $R_6$ and $R_7$ together may bond to form a 5- or 6-membered ring, and $L_4$, $L_5$, $L_6$, $L_7$, $L_8$, $n_1$, $n_2$, and $M^{\oplus}$ have the same meanings as those in formula (I).

13. The silver halide color photographic material as claimed in claim 1, wherein the total amount of the compounds represented by formulae (I), (II), and (III) used in the photographic material is 10 to 1,000 mg/m$^2$ of the photographic material.

14. The silver halide color photographic material as claimed in claim 1, wherein the photographic constitutional layers contain a low-calcium gelatin having calcium content of 800 ppm or less.

15. The silver halide color photographic material as claimed in claim 1, wherein the photographic constitutional layers contain gelatin in a total amount of 5.0 to 8.5 mg/m$^2$ of the photographic material.

16. The silver halide color photographic material as claimed in claim 1, wherein the at least one hydrophilic colloid layer contains calcium in a total amount of 10 mol % or less per total coating amount of silver.

17. The silver halide color photographic material as claimed in claim 1, wherein a swelling ratio (B) represented by $L_W/L_D$ (wherein $L_W$ represents the wet film thickness and $L_D$ represents the dried film thickness) of the photographic constitutional layers is 2.0 or less.

18. The silver halide color photographic material as claimed in claim 1, wherein the at least one hydrophilic colloid layer contains calcium in a total amount of 10 mol % or less per total coating amount of silver and a swelling ratio (B) represented by $L_W/L_D$ (wherein $L_W$ represents the wet film thickness and $L_D$ represents the dried film thickness) of the photographic constitutional layers is 2.0 or less.

19. The silver halide color photographic material as claimed in claim 1, wherein the center line average surface roughness (SRa) of the reflective support is 0.15 μm or less.

* * * * *